US005104759A

United States Patent [19]

Kato

[11] Patent Number: 5,104,759

[45] Date of Patent: Apr. 14, 1992

[54] ELECTROPHOTOGRAPHIC LIGHT-SENSITIVE MATERIAL

[75] Inventor: Eiichi Kato, Shizuoka, Japan

[73] Assignee: Fuji Photo Film Co., Ltd., Kanagawa, Japan

[21] Appl. No.: 638,922

[22] Filed: Jan. 9, 1991

[30] Foreign Application Priority Data

Jan. 9, 1990 [JP] Japan ..... 2-926

[51] Int. Cl.[5] ..... G03G 5/08

[52] U.S. Cl. ..... 430/96; 430/57; 430/58; 523/204

[58] Field of Search ..... 430/96, 57, 58; 523/204

[56] References Cited

U.S. PATENT DOCUMENTS 4,952,475 8/1990 Kato et al. ..... 430/96
5,001,029 3/1991 Kato et al. ..... 430/96
5,030,534 7/1991 Kato et al. ..... 430/96
5,077,166 12/1991 Kato et al. ..... 430/96

*Primary Examiner*—Marion E. McCamish
*Assistant Examiner*—S. Rosasco
*Attorney, Agent, or Firm*—Sughrue, Mion, Zinn, Macpeak & Seas

[57] ABSTRACT

An electrophotographic light-sensitive material comprising a support having provided thereon at least one photoconductive layer containing an inorganic photoconductive substance and a binder resin, wherein the binder resin comprises (A) at least one resin having a weight average molecular weight of from $1\times10^3$ to $2\times10^4$ and containing not less than 30% by weight of a copolymerizable component corresponding to a repeating unit represented by the general formula (I) described below and from 0.5 to 20% by weight of a copolymerizable component having at least one acidic group selected from the group consisting of $-PO_3H_2$, $-SO_3H$, $-COOH$, $-OH$, (wherein R represents a hydrocarbon group or —OR′ (wherein R′ represents a hydrocarbon group)) and a cyclic acid anhydride-containing group;

(I)

wherein $a_1$ and $a_2$ each represents a hydrogen atom, a halogen atom, a cyano group or a hydrocarbon group; and $R_1$ represents a hydrocarbon group; and (B) at least one graft type copolymer having a weight average molecular weight of from $3\times10^4$ to $1\times10^6$ and containing, as a copolymerizable component, at least one mono-functional macromonomer (M) having a weight average molecular weight of from $1\times10^3$ to $2\times10^4$ and comprising an AB block copolymer being composed of an A block comprising at least one polymerizable component containing at least one acidic group selected from $-PO_3H_2$, $-COOH$, $-SO_3H$, a phenolic hydroxyl group (wherein R represents a hydrocarbon group or —OR′ (wherein R′ represents a hydrocarbon group )) and a cyclic acid anhydride-containing group, and a B block containing at least one polymerizable component represented by the general formula (II) described below and having a polymerizable double bond group bonded to the terminal of the main chain of the B block polymer.

(II)

wherein $b_1$ and $b_2$ each represents a hydrogen atom, a halogen atom, a cyano group, a hydrocarbon group, $-COOR_{24}$ or $-COOR_{24}$ bonded via a hydrocarbon group (wherein $R_{24}$ represents a hydrogen atom or a hydrocarbon group); $X_1$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, $-SO_2-$, —CO—, (wherein $R_{23}$ represent a hydrogen atom or a hydrocarbon group), —CONHCOO—, —CONHCONH—, or and $R_{21}$ represents a hydrocarbon group, provided that when $X_1$ represents $R_{21}$ represents a hydrogen atom or a hydrocarbon group.

9 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic characteristics and moisture resistance.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. Particularly, a printing system using a direct electrophotographic printing plate has recently become important for providing high quality prints of from several handreds to several thousands.

Binders which are used for forming the photoconductive layer of an electrophotographic light-sensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to prior light-exposure and also have an excellent image forming properties, and the photoconductive layer stably maintains these electrostatic properties to change of humidity at the time of image formation.

Further, extensive investigations have been made on lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as a charging property, dark charge retention and light-sensitivity, and smoothness of the photoconductive layer.

Also, the practical evaluations on conventional binder resins which are said to be developed for electrophotographic lithographic master plates have found that they have problems in the above-described electrostatic characteristics, background staining of prints, etc.

In order to overcome these problems, JP-A-63-217354 and JP-A-1-70761 (the term "JP-A" as used herein means an "unexamined Japanese patent application") disclose improvements in the smoothness of the photoconductive layer and electrostatic characteristics by using, as a binder resin, a resin having a weight average molecular weight of from $1\times10^3$ to $1\times10^4$ and containing at random an acidic group in a side chain of the polymer or a resin having a weight average molecular weight of from $1\times10^3$ to $5\times10^5$ and having an acidic group bonded at only one terminal of the polymer main chain thereby obtaining an image having no background stains.

Also, JP-A-1-100554 and JP-A-1-214865 disclose a technique using, as a binder resin, a resin containing an acidic group in a side chain of the copolymer or at the terminal of the polymer main chain, and containing a polymerizable component having a heat- and/or photocurable functional group; JP-A-1-102573 and JP-A-2-874 disclose a technique using a resin containing an acidic group in a side chain of the copolymer or at the terminal of the polymer main chain, and a crosslinking agent in combination; JP-A-64-564, JP-A-63-220149, JP-A-63-220148, JP-A-1-280761, JP-A-1-116643 and JP-A-1-169455 disclose a technique using a resin having a low molecular weight (a weight average molecular weight of from $1\times10^3$ to $1\times10^4$) and a resin having a high molecular weight (a weight average molecular weight of $1\times10^4$ or more) in combination; and JP-A-1-211766 and JP-A-2-34859 disclose a technique using the above low molecular weight resin and a heat- and/or photo-curable resin in combination. These references disclose that, according to the proposed technique, the film strength of the photoconductive layer can be increased sufficiently and also the mechanical strength of the light-sensitive material can be increased without adversely affecting the above-described electrostatic characteristics by using a resin containing an acidic group in a side chain or at the terminal of the polymer main chain.

On the other hand, in order to evaluate electrostatic characteristics of electrophotographic light-sensitive material, values of $E_{1/2}$ and $E_{1/10}$ which are obtained by exposure amounts corresponding to times required for decay of the surface potential to ½ and 1/10, respectively are conventionally employed. These two values are important factors for evaluating reproducibility of original in practical image formation. More specifically, as the values of $E_{\frac{1}{2}}$ and $E_{1/10}$ are small and a difference thereof is small, a clear duplicated image without blur can be reproduced.

In addition, another point at the image formation is a degree of electrical potential remaining in the exposed area (non-image area) after light exposure. When the degree of remaining electrical potential is high at the image formation, background stains are formed in the non-image area of duplicated images. An electrostatic characteristic mainly corresponding to this subject is a value of $E_{1/100}$. The smaller the value, the better the image forming performance.

In particular, in a recent scanning exposure system using a semiconductor laser beam, the value of $E_{1/100}$ becomes an important factor in addition to the charging property ($V_{10}$), dark decay retention rate (DRR) and $E_{1/10}$ conventionally employed, since there is a restriction on the power of laser beam.

In case of using a resin having a low molecular weight and containing an acidic group and a resin having a high molecular weight or a heat- and/or photocurable resin in combination as above described known techniques, the $V_{10}$, DRR and $E_{1/10}$ are reached to a substantially satisfactory level. However, it has been found that the value of $E_{1/100}$ obtained in the case of changing the environmental conditions or in the case of using a laser beam of small power is not sufficient and background fog occurs in duplicated images.

SUMMARY OF THE INVENTION

The present invention has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the environmental conditions during the formation of duplicated images are changed to a low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of the present invention is to provide an electrophotographic lithographic printing plate precursor forming neither background stains nor edge marks of originals pasted up on the prints.

Other objects of the present invention will become apparent from the following description and examples.

It has been found that the above described objects of the present invention are accomplished by an electrophotographic light-sensitive material comprising a support having provided thereon at least one photoconductive layer containing an inorganic photoconductive substance and a binder resin, wherein the binder resin comprises (A) at least one resin having a weight average molecular weight of from $1\times10^3$ to $2\times10^4$ and containing not less than 30% by weight of a copolymerizable component corresponding to a repeating unit represented by the general formula (I) described below and from 0.5 to 20% by weight of a copolymerizable component having at least one acidic group selected from the group consisting of $-PO_3H_2$, $-SO_3H$, $-COOH$, $-OH$,

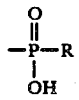

(wherein R represents a hydrocarbon group or —OR' (wherein R' represents a hydrocarbon group)) and a cyclic acid anhydride-containing group;

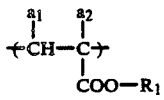

(I)

wherein $a_1$ and $a_2$ each represents a hydrogen atom, a halogen atom, a cyano group or a hydrocarbon group; and $R_1$ represents a hydrocarbon group; and (B) at least one graft type copolymer having a weight average molecular weight of from $3\times10^4$ to $1\times10^6$ and containing, as a copolymerizable component, at least one mono-functional macromonomer (M) having a weight average molecular weight of from $1\times10^3$ to $2\times10^4$ and comprising an AB block copolymer being composed of an A block comprising at least one polymerizable component containing at least one acidic group selected from $-PO_3H_2$, $-COOH$, $-SO_3H$, a phenolic hydroxyl group,

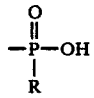

(wherein R represents a hydrocarbon group or —OR' (wherein R' represents a hydrocarbon group)) and a cyclic acid anhydride-containing group, and a B block containing at least one polymerizable component represented by the general formula (II) described below and having a polymerizable double bond group bonded to the terminal of the main chain of the B block polymer;

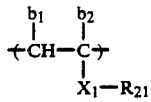

(II)

wherein $b_1$ and $b_2$ each represents a hydrogen atom, a halogen atom, a cyano group, a hydrocarbon group, $-COOR_{24}$ or $-COOR_{24}$ bonded via a hydrocarbon group (wherein $R_{24}$ represents a hydrogen atom or a hydrocarbon group); $X_1$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, $-SO_2-$, —CO—,

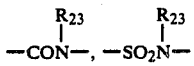

(wherein $R_{23}$ represents a hydrogen atom or a hydrocarbon group), —CONHCOO—, —CONHCONH—, or

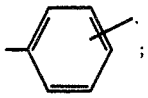

and $R_{21}$ represents a hydrocarbon group, provided that when $X_1$ represents

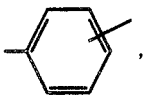

$R_{21}$ represents a hydrogen atom or a hydrocarbon group.

DETAILED DESCRIPTION OF THE INVENTION

The binder resin which can be used in the present invention comprises at least (A) a low-molecular weight resin (hereinafter referred to as resin (A)) containing the copolymerizable component having the specific repeating unit and the copolymerizable component containing the acidic group (the term "acidic group" as used herein means and includes a cyclic acid anhydride-containing group, unless otherwise indicated) and (B) a high-molecular weight resin (hereinafter referred to as resin (B)) composed of a graft type copolymer containing, as a copolymerizable component, at least one mono-functional macromonomer (M) comprising an AB block copolymer being composed of an A block comprising a polymerizable component containing the specific acidic group described above and a B block comprising a polymerizable component represented by the general formula (II) described above and having a polymerizable double bond group bonded to the terminal of the main chain of the B block polymer.

According to a preferred embodiment of the present invention, the low molecular weight resin (A) is a low molecular weight resin (hereinafter referred to as resin (A')) containing an acidic group-containing component and a methacrylate component having a specific substituent containing a benzene ring which has a specific substituent(s) at the 2-position or 2- and 6-positions thereof or a specific substituent containing an unsubstituted naphthalene ring represented by the following general formula (Ia) or (Ib):

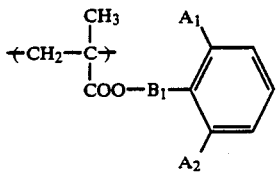

(Ia)

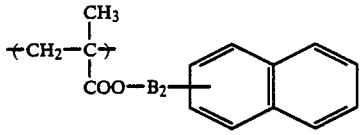

(Ib)

wherein $A_1$ and $A_2$ each represents a hydrogen atom, a hydrocarbon group having from 1 to 10 carbon atoms, a chlorine atom, a bromine atom, $—COD_1$ or $—COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

According to another preferred embodiment of the present invention, the high molecular weight resin (B) is a graft type copolymer containing at least one macromonomer (M) described above and a polymerizable component represented by the following general formula (III):

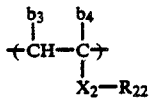

(III)

wherein $b_3$, $b_4$, $X_2$ and $R_{22}$ each has the same meaning as defined for $b_1$, $b_2$, $X_1$ and $R_{21}$.

In the present invention, the acidic group contained in the resin (A) of a low molecular weight which contains the specific copolymerizable component as well as the acidic group is adsorbed onto stoichiometrical defects of an inorganic photoconductive substance, and the resin has a function to improve covering power for the photoconductive substance due to its low molecular weight, to sufficiently cover the surface thereof, whereby electron traps of the photoconductive substance can be compensated for and humidity resistance can be greatly improved, while assisting the photoconductive substance to be sufficiently dispersed without agglomeration. On the other hand, the resin (B) not only serves to sufficiently heighten the mechanical strength of a photoconductive layer, which may be insufficient in case of using the resin (A) alone, without damaging the excellent electrophotographic characteristics attained by the use of the resin (A), but also provides sufficiently high image forming performance in the case of changing the environmental conditions or in the case of using a laser beam of small power.

It is believed that the excellent characteristics of the electrophotographic light-sensitive material can be obtained by employing the resin (A) and the resin (B) as binder resins for inorganic photoconductive substance, wherein the weight average molecular weight of the resins and the content and position of the acidic group therein are specified, whereby the strength of interactions between the inorganic photoconductive substance and the resins can be appropriately controlled. More specifically, it is believed that the electrophotographic characteristics and mechanical strength of the layer as described above can be greatly improved by the fact that the resin (A) having a relatively strong interaction to the inorganic photoconductive substance selectively adsorbes thereon; whereas, in the resin (B) which has a weak activity compared with the resin (A), the acidic group bonded to the specific position to the polymer main chain thereof mildly interacts with the inorganic photoconductor to a degree which does not damage the electrophotographic characteristics, and the long main molecular chain and the molecular chains of the graft portion mutually interact between the resins (B).

In case of using the resin (A'), the electrophotographic characteristics, particularly, $V_{10}$, DRR and $E_{1/10}$ of the electrophotographic material can be furthermore improved as compared with the use of the resin (A). While the reason of this fact is not fully clear, it is believed that the polymer molecular chain of the resin (A') suitably arranges on the surface of inorganic photoconductive substance such as zinc oxide in the layer depending on the plane effect of the benzene ring having a substituent at the ortho position or the naphthalene ring which is an ester component of the methacrylate whereby the above described improvement is achieved.

Further, according to the present invention, the smoothness of the photoconductive layer is improved.

On the contrary, when an electrophotographic light-sensitive material having a photoconductive layer with a rough surface is used as an electrophotographic lithographic printing plate precursor, the dispersion state of inorganic particles as photoconductive substance and a binder resin is improper and thus a photoconductive layer is formed in a state containing aggregates of the photoconductive substance, whereby the surface of the non-image portions of the photoconductive layer is not uniformly and sufficiently rendered hydrophilic by applying thereto an oil-desensitizing treatment with an oil-desensitizing solution to cause attaching of printing ink at printing, which results in the formation of background stain in the non-image portions of prints.

According to the present invention, the interaction of adsorption and covering between the inorganic photoconductive substance and the binder resins is suitably performed, and the sufficient mechanical strength of the photoconductive layer is achieved by the combination of the resins described above.

In the resin (A), the weight average molecular weight is suitably from $1\times10^3$ to $2\times10^4$, preferably from $3\times10^3$ to $1\times10^4$, the content of the copolymerizable component corresponding to the repeating unit represented by the general formula (I) is suitably not less than 30% by weight, preferably from 50 to 97% by weight, and the content of the acidic group-containing copolymerizable component is suitably from 0.5 to 20% by weight, preferably from 1 to 10% by weight.

In the resin (A'), the content of the methacrylate copolymerizable component corresponding to the repeating unit represented by the general formula (Ia) or (Ib) is suitably not less than 30% by weight, preferably from 50 to 97% by weight, and the content of the acidic group-containing copolymerizable component is suitably from 0.5 to 20% by weight, preferably from 1 to 10% by weight.

The glass transition point of the resin (A) is preferably from −20° C. to 110° C., and more preferably from −10° C. to 90° C.

On the other hand, the weight average molecular weight of the resin (B) is suitably from $3\times10^4$ to $1\times10^6$, preferably from $5\times10^4$ to $5\times10^5$.

The glass transition point of the resin (B) is preferably from 0° C. to 110° C., and more preferably from 20° C. to 90° C.

The content of the mono-functional macromonomer comprising an AB block copolymer component in the resin (B) is preferably from 1 to 60% by weight, more preferably from 5 to 50% by weight, and the content of the polymerizable component represented by the general formula (III) is preferably from 40 to 99% by weight, more preferably from 50 to 95% by weight.

If the molecular weight of the resin (A) is less than $1\times10^3$, the film-forming ability thereof is undesirably reduced, whereby the photoconductive layer formed cannot keep a sufficient film strength, while if the molecular weight thereof is larger than $2\times10^4$, the fluctuations of electrophotographic characteristics (in particular, dark decay retention rate and photosensitivity of $E_{1/10}$) of the photoconductive layer containing a spectral sensitizing dye for the sensitization in the range of from near-infrared to infrared become somewhat large and thus the effect for obtaining stable dupricated images according to the present invention is reduced under severe conditions of high temperature and high humidity or low temperature and low humidity.

If the content of the acidic group-containing copolymerizable component in the resin (A) is less than 0.5% by weight, the resulting electrophotographic light-sensitive material has an initial potential too low to provide a sufficient image density. If, on the other hand, it is more than 20% by weight, dispersibility of the photoconductive substance is reduced, the smoothness of the photoconductive layer and the electrophotographic characteristics thereof under a high humidity condition are deteriorated. Further, background stain is increased when it is used as an offset master.

If the molecular weight of the resin (B) is less than $3\times10^4$, a sufficient film strength may not be maintained. On the other hand, if the molecular weight thereof is larger than $1\times10^6$, the dispersibility of the photoconductive substance is reduced, the smoothness of the photoconductive layer is deteriorated, and image quality of duplicated images (particularly reproducibility of fine lines and letters) is degraded. Further, the background stain increases in case of using as an offset master.

Further, if the content of the macromonomer is less than 1% by weight in the resin (B), electrophotographic characteristics (particularly dark decay retention rate and photosensitivity) may be reduced and the fluctuations of electrophotographic characteristics of the photoconductive layer, particularly that containing a spectral sensitizing dye for the sensitization in the range of from near-infrared to infrared become large under severe conditions. The reason therefor is considered that the construction of the polymer becomes similar to that of a conventional homopolymer or random copolymer resulting from the slight amount of macromonomer portion present therein.

On the other hand, if the content of the macromonomer is more than 60% by weight, the copolymerizability of the macromonomer with other monomers corresponding to other copolymerizable components may become insufficient, and the sufficient electrophotographic characteristics can not be obtained as the binder resin.

Now, the resin (A) which can be used in the present invention will be explained in detail below.

The resin (A) used in the present invention contains at random a repeating unit represented by the general formula (I) and a repeating unit containing the acidic group as copolymerizable components as described above. Two or more kinds of each of these repeating units may be contained in the resin (A).

In the general formula (I), $a_1$ and $a_2$ each represents a hydrogen atom, a halogen atom (e.g., chlorine and bromine), a cyano group or a hydrocarbon group, preferably an alkyl group having from 1 to 4 carbon atoms (e.g., methyl, ethyl, propyl and butyl); and $R_1$ represents a hydrocarbon group, preferably a substituted or unsubstituted alkyl group having from 1 to 18 carbon atoms (e.g., methyl, ethyl, propyl, butyl, pentyl, hexyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 3-hydroxypropyl), a substituted or unsubstituted alkenyl group having from 2 to 18 carbon atoms (e.g., vinyl, allyl, isopropenyl, butenyl, hexenyl, heptentyl, and octenyl), a substituted or unsubstituted aralkyl group having from 7 to 12 carbon atoms (e.g., benzyl, phenethyl, naphthylmethyl, 2-naphthylethyl, methoxybenzyl, ethoxybenzyl, and methylbenzyl), a substituted or unsubstituted cycloalkyl group having from 5 to 8 carbon atoms (e.g., cyclopentyl, cyclohexyl, and cycloheptyl), or a substituted or unsubstituted aryl group (e.g., phenyl, tolyl, xylyl, mesityl, naphthyl, methoxyphenyl, ethoxyphenyl, fluorophenyl, difluorophenyl, bromophenyl, chlorophenyl, dichlorophenyl, iodophenyl, methoxycarbonylphenyl, ethoxycarbonylphenyl, cyanophenyl, and nitrophenyl).

More preferably, the copolymerizable component corresponding to the repeating unit represented by the general formula (I) is a methacrylate component having the specific aryl group represented by the following general formula (Ia) or (Ib):

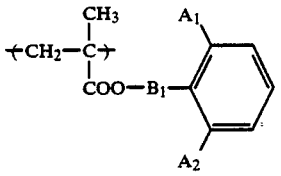

(Ia)

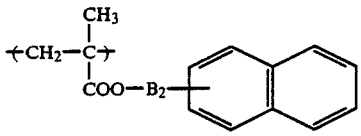

(Ib)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

In the general formula (Ia), $A_1$ and $A_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), —$COD_1$ or —$COOD_2$, wherein $D_1$ and $D_2$ each preferably represents any of the above-recited hydrocarbon groups).

In the general formula (Ia), $B_1$ is a mere chemical bond or a linking group containing from 1 to 4 linking atoms, e.g., $\text{-}(CH_2)_{n_1}\text{-}$ ($n_1$ represents an integer of 1, 2, or 3), —$CH_2OCO$—, —$CH_2CH_2OCO$—, $\text{-}(CH_2O)_{n_2}\text{-}$ ($n_2$ represents an integer of 1 or 2), and —$CH_2CH_2O$—, which connects —COO— and the benzene ring.

In the general formula (Ib), $B_2$ has the same meaning as $B_1$ in the general formula (Ia).

Specific examples of the copolymerizable component corresponding to the repeating unit represented by the general formula (Ia) or (Ib) which can be used in the resin ($A^1$) according to the present invention are set forth below, but the present invention should not be construed as being limited thereto. In the following formulae, $T_1$ and $T_2$ each represents Cl, Br or I; $R_{11}$ represents —$C_aH_{2a+1}$ or

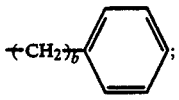

a represents an integer of from 1 to 4; b represents an integer of from 0 to 3; and c represents an integer of from 1 to 3.

i-1)

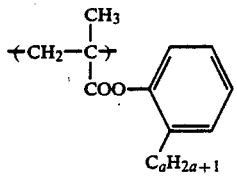

i-2)

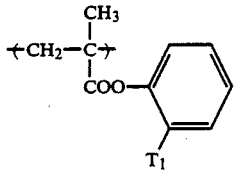

i-3)

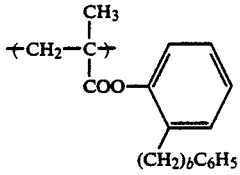

i-4)

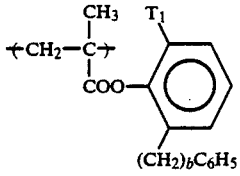

i-5)

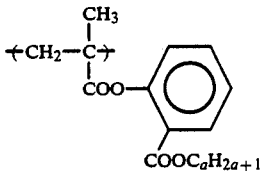

i-6)

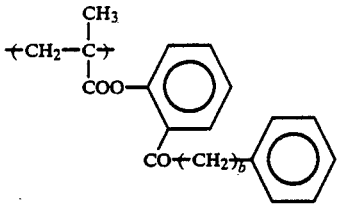

i-7)

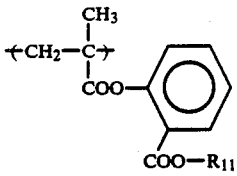

i-8)

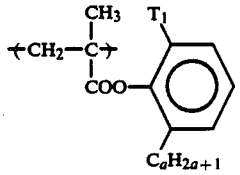

-continued i-9)

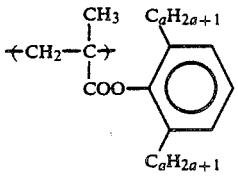

i-10)

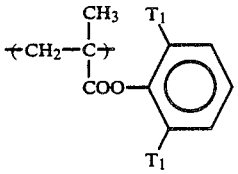

i-11)

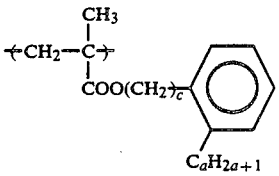

i-12)

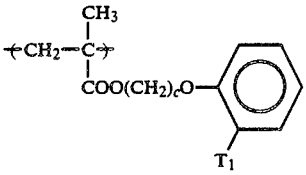

i-13)

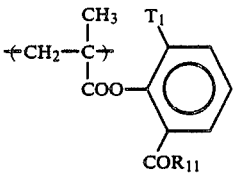

i-14)

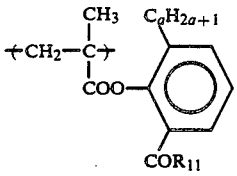

i-15)

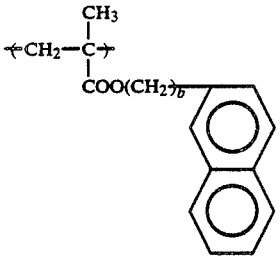

i-16)

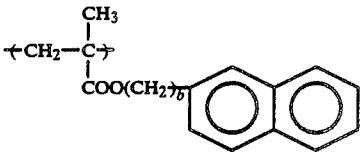

i-17)

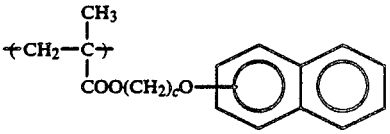

-continued i-18)

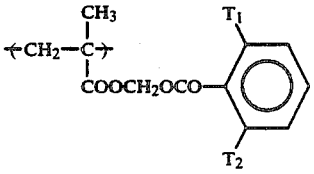

i-19)

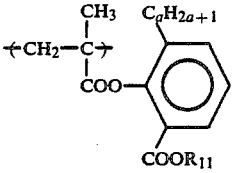

i-20)

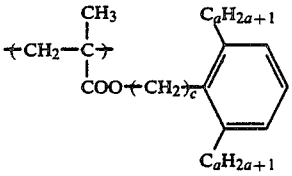

In the copolymerizable component containing the acidic group of the resin (A) according to the present invention, the acidic group preferably includes $-PO_3H_2$, $-SO_3H$, $-COOH$,

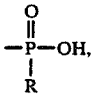

and a cyclic acid anhydride-containing group.

In the acidic group

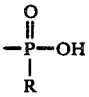

above, R represents a hydrocarbon group or OR', wherein R' represents a hydrocarbon group. The hydrocarbon group represented by R or R' preferably includes an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and a substituted or unsubstituted aryl group (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The cyclic acid anhydride-containing group is a group containing at least one cyclic acid anhydride. The cyclic acid anhydride to be contained includes aliphatic dicarboxylic acid anhydrides and aromatic dicarboxylic acid anhydrides.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-

2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalene-dicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Compounds containing —OH group include alcohols containing a vinyl group or an allyl group (e.g., allyl alcohol, methacrylates containing —OH group in an ester substituent thereof, and arylamides containing —OH group in an N-substituent thereof), hydroxyphenol, and methacrylates or amides containing a hydroxyphenyl group as a substituent.

The copolymerizable component containing the acidic group may be any of acidic group-containing vinyl compounds copolymerizable with, for example, a monomer corresponding to the repeating unit represented by the general formula (I) (including that represented by the general formula (Ia) or (Ib)). Examples of such vinyl compounds are described, e.g., in Kobunshi Gakkai (ed.), *Kobunshi Data Handbook* (*Kisohen*), Baihukan (1986). Specific examples of these vinyl monomers include acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the acidic group in the substituent thereof.

Specific examples of the acidic group-containing copolymerizable components are set forth below, but the present invention should not be construed as being limited thereto. In the following formulae, $P_1$ represents —H or —$CH_3$; $P_2$ represents —H, —$CH_3$ or —$CH_2COOCH_3$; $R_{12}$ represents an alkyl group having from 1 to 4 carbon atoms; $R_{13}$ represents an alkyl group having from 1 to 6 carbon atoms, a benzyl group or a phenyl group; c represents an integer of from 1 to 3; d represents an integer of from 2 to 11; e represents an integer of from 1 to 11; f represents an integer of from 2 to 4; and g represents an integer of from 2 to 10.

ii-1)

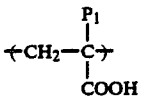

ii-2)

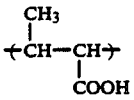

-continued ii-3)

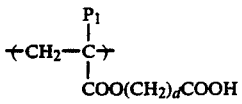

ii-4)

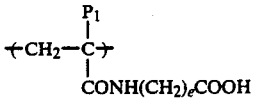

ii-5)

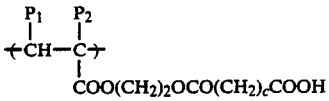

ii-6)

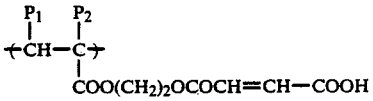

ii-7)

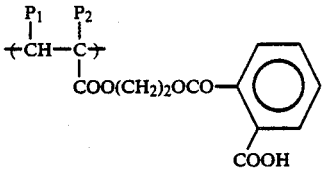

ii-8)

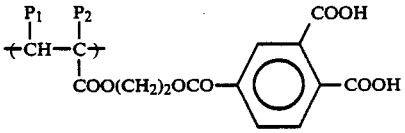

ii-9)

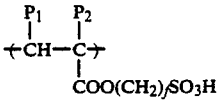

ii-10)

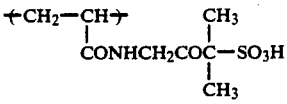

ii-11)

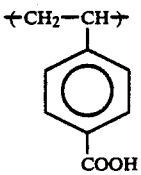

ii-12)

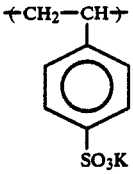

ii-13)

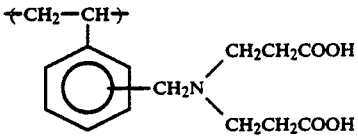

-continued
ii-14)
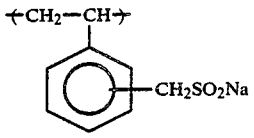
ii-15)
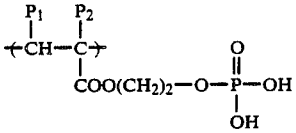
ii-16)
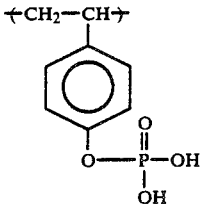
ii-17)
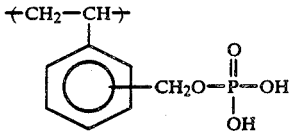
ii-18)
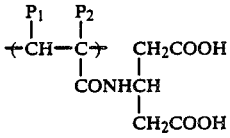
ii-19)
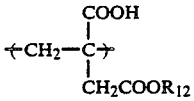
ii-20)
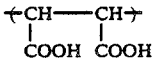
ii-21)
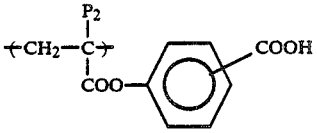
ii-22)
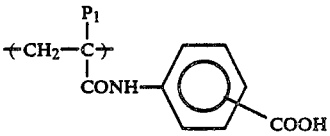
ii-23)
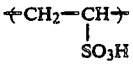
ii-24)
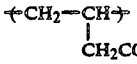
ii-25)
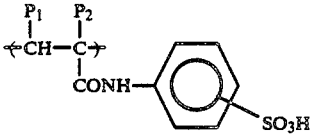
-continued
ii-26)
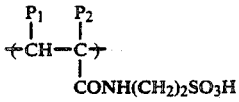
ii-27)
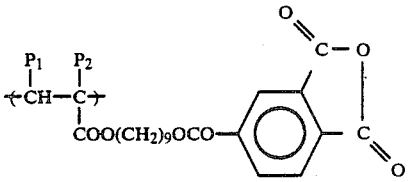
ii-28)
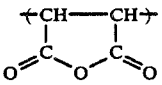
ii-29)
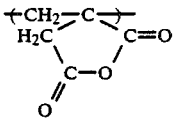
ii-30)
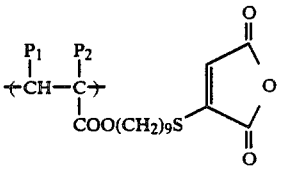
ii-31)
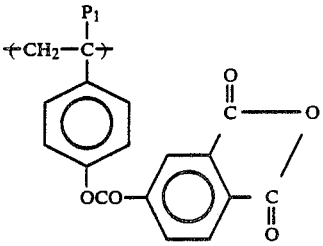
ii-32)
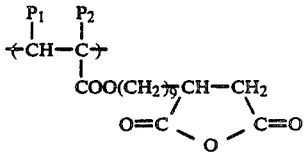
ii-33)
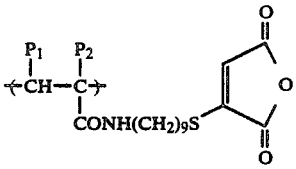
ii-34)
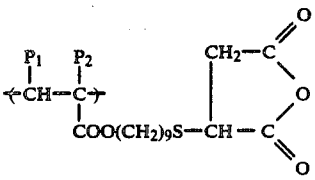

-continued ii-35)

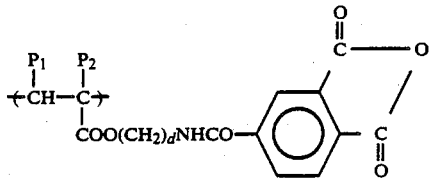

ii-36)

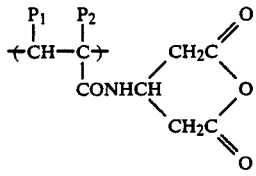

ii-37)

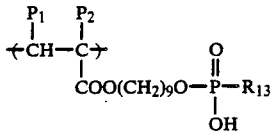

ii-38)

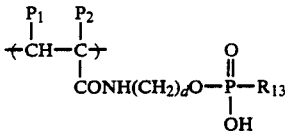

ii-39)

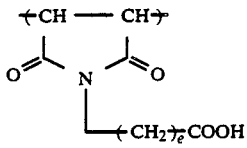

ii-40)

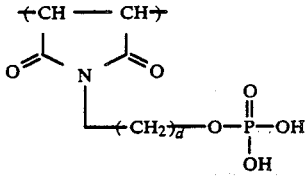

ii-41)

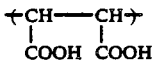

ii-42)

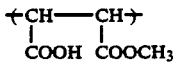

ii-43)

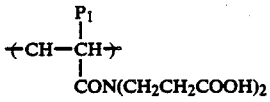

ii-44)

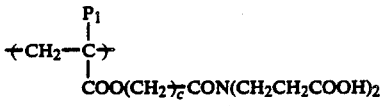

ii-45)

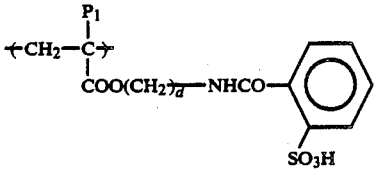

-continued ii-46)

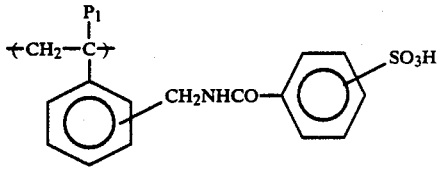

ii-47)

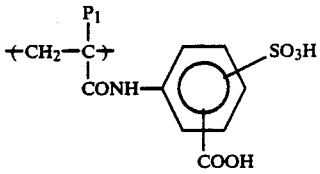

ii-48)

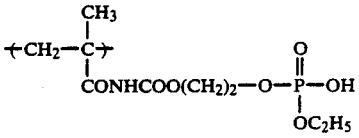

ii-49)

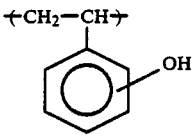

ii-50)

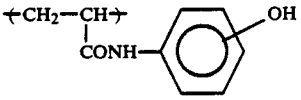

ii-51)

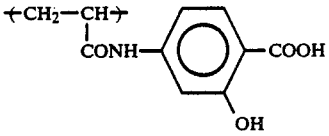

ii-52)

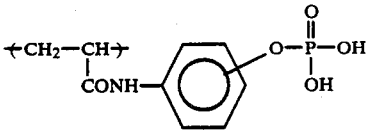

Moreover, the binder resin (A) preferably contains from 1 to 20% by weight of a copolymerizable component having a heat- and/or photo-curable functional group in addition to the copolymerizable component represented by the general formula (I) (including that represented by the general formula (Ia) or (Ib)) and the copolymerizable component containing the acidic group described above, in view of achieving higher mechanical strength.

The term "heat- and/or photo-curable functional group" as used herein means a functional group capable of inducing curing reaction of a resin on application of at least one of heat and light.

Specific examples of the photo-curable functional group include those used in conventional photosensitive resins known as photocurable resins as described, for example, in Hideo Inui and Gentaro Nagamatsu, *Kankosei Kobunshi*, Kodansha (1977), Takahiro Tsunoda, *Shin-Kankosei Jushi*, Insatsu Gakkai Shuppanbu (1981), G. E. Green and B. P. Strak, *J. Macro. Sci. Reas. Macro. Chem.*, C 21 (2), pp. 187 to 273 (1981–82), and C. G. Rattey, *Photopolymerization of Surface Coatings*, A Wiley Interscience Pub. (1982).

The heat-curable functional group which can be used includes functional groups excluding the above-specified acidic groups. Examples of the heat-curable functional groups are described, for example, in Tsuyoshi Endo, *Netsukokasei Kobunshi no Seimitsuka,* C.M.C. (1986), Yuji Harasaki, *Saishin Binder Gijutsu Binran,* Chapter II-I, Sogo Gijutsu Center (1985), Takayuki Ohtsu, *Acryl Jushi no Gosei Sekkei to Shin-Yotokaihatsu,* Chubu Kei-ei Kaihatsu Center Shuppanbu (1985), and Eizo Ohmori, *Kinosei Acryl Kei Jushi,* Techno System (1985).

Specific examples of the heat-curable functional group which can used include —OH, —SH, —$NH_2$, —$NHR_3$ (wherein $R_3$ represents a hydrocarbon group, for example, a substituted or unsubstituted alkyl group having from 1 to 10 carbon atoms (e.g., methyl, ethyl, propyl, butyl, hexyl, octyl, decyl, 2-chloroethyl, 2-methoxyethyl, and 2-cyanoethyl), a substituted or unsubstituted cycloalkyl group having from 4 to 8 carbon atoms (e.g., cycloheptyl and cyclohexyl), a substituted or unsubstituted aralkyl group having from 7 to 12 carbon atoms (e.g., benzyl, phenethyl, 3-phenylpropyl, chlorobenzyl, methylbenzyl, and methoxybenzyl), and a substituted or unsubstituted aryl group (e.g., phenyl, tolyl, xylyl, chlorophenyl, bromophenyl, methoxyphenyl, and naphthyl)),

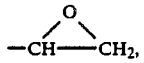

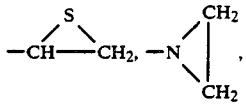

—$CONHCH_2OR_4$ (wherein $R_4$ represents a hydrogen atom or an alkyl group having from 1 to 8 carbon atoms (e.g., methyl, ethyl, propyl, butyl, hexyl, and octyl), —N=C=O and

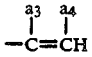

(wherein $a_3$ and $a_4$ each represents a hydrogen atom, a halogen atom (e.g., chlorine and bromine) or an alkyl group having from 1 to carbon atoms (e.g., methyl and ethyl)).

Another examples of the functional group include polymerizable double bond groups, for example, $CH_2$=CH—,

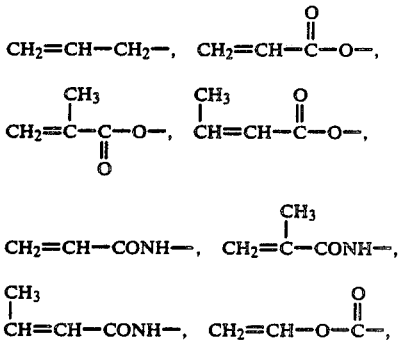

-continued

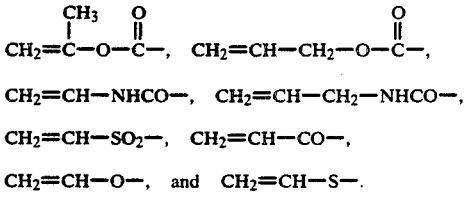

In order to introduce at least one functional group selected from the heat- and/or photo-curable functional groups into the binder resin according to the present invention, a method comprising introducing the functional group into a polymer by high molecular reaction or a method comprising copolymerizing at least one monomer containing at least one of the functional groups, a monomer corresponding to the repeating unit of the general formula (I) (including that of the general formula (Ia) or (Ib)), and a monomer corresponding to the acidic group-containing copolymerizable component can be employed.

The above-described high molecular reaction can be carried out by using conventionally known low molecular synthesis reactions. For the details, reference can be made to, e.g., Nippon Kagakukai (ed.), *Shin-Jikken Kagaku Koza,* Vol. 14, *Yuki Kagobutsu no Gosei to Hanno* (I) to (V), Maruzen K.K. and Yoshio Iwakura and Keisuke Kurita, *Hannosei Kobunshi.*

Suitable examples of the monomers containing the functional group capable of inducing heat- and/or photo-curable reaction include vinyl compounds copolymerizable with the monomers corresponding to the repeating unit of the general formula (I) and containing the above-described functional group. More specifically, compounds similar to those described above as acidic group-containing compounds and further containing the above-described functional group in their substituent are illustrated.

Specific examples of the heat- and/or photo-curable functional group-containing repeating unit are set forth below, but the present invention should not be construed as being limited thereto. In the following formulae, $R_{11}$, a, b and e each has the same meaning as defined above; $P_1$ and $P_3$ each represents —H or —$CH_3$; $R_{14}$ represents —CH=$CH_2$ or —$CH_2CH$=$CH_2$; $R_{15}$ represents —CH=$CH_2$,

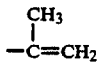

or —CH=$CHCH_3$; $R_{16}$ represents —CH=$CH_2$, —$CH_2CH$=$CH_2$,

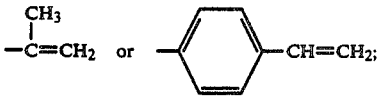

Z represents S or O; $T_3$ represents —OH or —$NH_2$; h represents an integer of from 1 to 11; and i represents an integer of from 1 to 10.

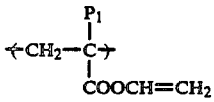

iii-1)

-continued iii-2)

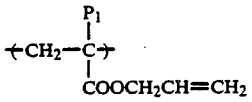

iii-3)

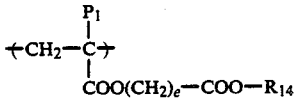

iii-4)

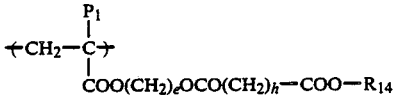

iii-5)

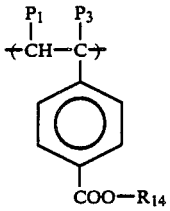

iii-6)

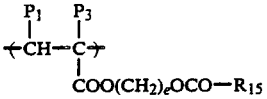

iii-7)

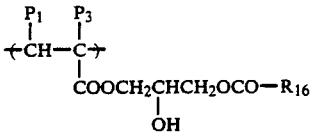

iii-8)

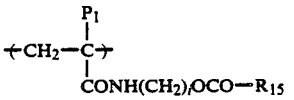

iii-9)

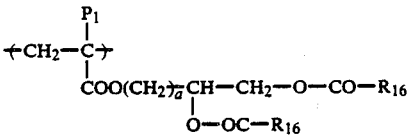

iii-10)

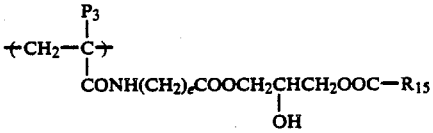

iii-11)

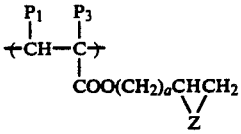

iii-12)

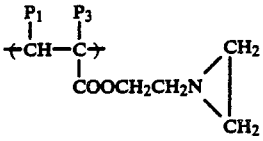

iii-13)

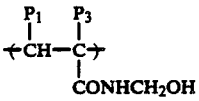

-continued iii-14)

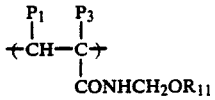

iii-15)

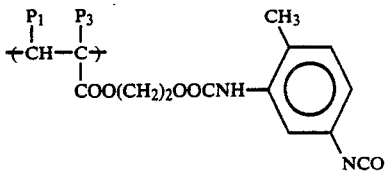

iii-16)

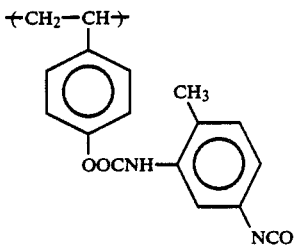

iii-17)

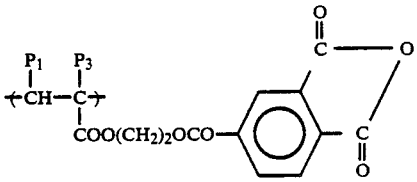

iii-18)

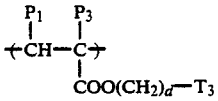

iii-19)

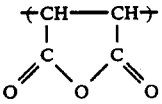

iii-20)

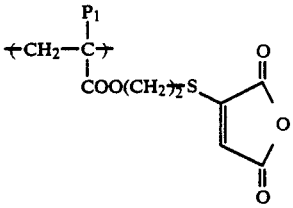

The resin (A) according to the present invention may further comprise other copolymerizable monomers as copolymerizable components in addition to the monomer corresponding to the repeating unit of the general formula (I) (including that of the general formula (Ia) or (Ib)), the acidic group-containing monomer, and, if desired, the heat- and/or photo-curable functional group-containing monomer. Examples of such monomers include, in addition to methacrylic acid esters, acrylic acid esters and crotonic acid esters other than those represented by the general formula (I), α-olefins, vinyl or allyl esters of carboxylic acids (including, e.g., acetic acid, propionic acid, butyric acid, valeric acid, benzoic acid, and naphthalenecarboxylic acid, as examples of the carboxylic acids), acrylonitrile, methacrylonitrile, vinyl ethers, itaconic acid esters (e.g., dimethyl itaconate, and diethyl itaconate), acrylamides, methacrylamides, styrenes (e.g., styrene, vinyltoluene, chlorostyrene, N,N-dimethylaminomethylstyrene, methoxycarbonylstyrene, methanesulfonyloxystyrene, and vinylnaphthalene), vinylsulfone-containing compounds, vinylketone-containing compounds, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

In such a case, the content of the other copolymerizable monomers is preferably not more than 20% by weight.

Now, the resin (B) will be described in detail with reference to preferred embodiments below.

The mono-functional macromonomer (M) which can be employed in the resin (B) according to the present invention is described in greater detail below.

The acidic group contained in a component which constitutes the A block of the macromonomer (M) includes $-PO_3H_2$, $-COOH$, $-SO_3H$, a phenolic hydroxy group,

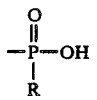

(R represents a hydrocarbon group or —OR' (wherein R' represents a hydrocarbon group)), and a cyclic acid anhydride-containing group, and the preferred acidic groups are $-COOH$, $-SO_3H$, a phenolic hydroxy group, and

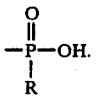

The

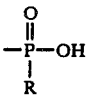

group has the same meaning as defined in the resin (A) above.

Further, specific examples of the polymerizable components containing the specific acidic group for the resin (B) include those described for the resin (A) above.

Two or more kinds of the above-described polymerizable components each containing the specific acidic group can be included in the A block. In such a case, two or more kinds of these acidic group-containing polymerizable components may be present in the form of a random copolymer or a block copolymer.

Also, other components having no acidic group may be contained in the A block, and examples of such components include the components represented by the genaral formula (II) described in detail below. The content of the component having no acidic group in the A block is preferably from 0 to 50% by weight, and more preferably from 0 to 20% by weight. It is most preferred that such a component is not contained in the A block.

Now, the polymerizable component constituting the B block in the mono-functional macromonomer of the graft type copolymer (resin (B)) used in the present invention will be explained in more detail below.

The components constituting the B block in the present invention include at least a repeating unit represented by the general formula (II) described above.

In the general formula (II), $X_1$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, $-SO_2-$, —CO—,

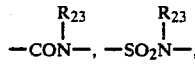

—CONHCOO—, —CONHCONH—, or

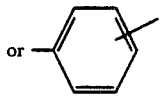

(wherein $R_{23}$ represents a hydrogen atom or a hydrocarbon group).

Preferred examples of the hydrocarbon group represented by $R_{23}$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-porpenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

In the general formula (II), $R_{21}$ represents a hydrocarbon group, and preferred examples thereof include those described for $R_{23}$. When $X_1$ represents

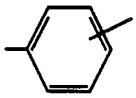

in the general formula (II), $R_{21}$ represents a hydrogen atom or a hydrocarbon group.

When $X_1$ represents

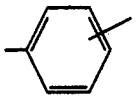

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In the general formula (II), $b_1$ and $b_2$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), —COO—$R_{24}$ or —COO—$R_{24}$ bonded via a hydrocarbon group, wherein $R_{24}$ represents a hydrogen atom or a hydrocarbon group (preferably an alkyl group having 1 to 18 carbon atoms, an alkenyl group having 4 to 18 carbon atoms, an aralkyl group having 7 to 12 carbon atoms, an alicyclic group having 5 to 8 carbon atoms or an aryl group having 6 to 12 carbon atoms, each of which may be substituted). More specifically, the examples of the hydrocarbon groups are those described for $R_{23}$ above. The hydrocarbon group via which —COO—$R_{24}$ is bonded includes, for example, a methylene group, an ethylene group, and a propylene group.

More preferably, in the general formula (II), $X_1$ represents —COO—, —OCO—, —$CH_2$OCO—, —$CH_2$COO—, —O—, —CONH—, —$SO_2$HN— or

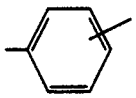

and $b_1$ and $b_2$, which may be the same or different, each represents a hydrogen atom, a methyl group, —$COOR_{24}$, or —$CH_2COOR_{24}$, wherein $R_{24}$ represents a hydrogen atom or an alkyl group having from 1 to 6 carbon atoms (e.g., methyl, ethyl, propyl, butyl, and hexyl). Most preferably, either one of $b_1$ and $b_2$ represents a hydrogen atom.

The B block which is constituted separately from the A block which is composed of the polymerizable component containing the above-described specific acidic group may contain two or more kinds of the repeating units represented by the general formula (II) described above and may further contain polymerizable components other than these repeating units. When the B block having no acidic group contains two or more kinds of the polymerizable components, the polymerizable components may be contained in the B block in the form of a random copolymer or a block copolymer, but are preferably contained at random therein.

As the polymerizable component other than the repeating units represented by the general formula (II) which is contained in the B block together with the polymerizable component(s) selected from the repeating units of the general formula (II), any components copolymerizable with the repeating units can be used.

Suitable examples of monomer corresponding to the repeating unit copolymerizable with the polymerizable component represented by the general formula (II), as a polymerizable component in the B block include acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). Such other monomers are employed in a range of not more than 20 parts by weight per 100 parts by weight of the total polymerizable components in the B block.

Further, it is preferred that the B block does not contain the polymerizable component containing an acidic group which is a component constituting the A block.

As described above, the macromonomer (M) to be used in the present invention has a structure of the AB block copolymer in which a polymerizable double bond-containing group is bonded to one of the terminals of the B block composed of the polymerizable component represented by the general formula (II) and the other terminal thereof is connected to the A block composed of the polymerizable component containing the acidic group. The polymerizable double bond-containing group will be described in detail below.

Suitable examples of the polymerizable double bond-containing group include those represented by the following general formula (IV):

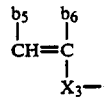

(IV)

wherein $X_3$ has the same meaning as $X_1$ defined in the general formula (II), and $b_5$ and $b_6$, which may be the same or different, each has the same meaning as $b_1$ and $b_2$ defined in the general formula (II).

Specific examples of the polymerizable double bond-containing group represented by the general formula (IV) include

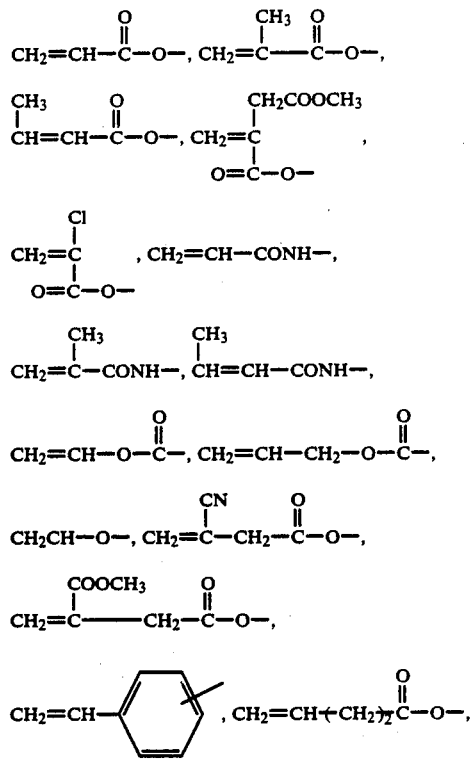

-continued $CH_2{=}CH{-}CO{-}$ and $CH_2{=}CH{+}CH_2{+}_2O{-}\overset{O}{\overset{\|}{C}}{-}$.

The macromonomer (M) used in the present invention has a structure in which a polymerizable double bond-containing group preferably represented by the general formula (IV) is bonded to one of the terminals of the B block either directly or through an appropriate linking group.

The linking group which can be used includes a carbon-carbon bond (either single bond or double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the bond between the group of the general formula (IV) and the terminal of the B block is a mere bond or a linking group selected from $$\left{+}\overset{R_{25}}{\underset{R_{26}}{C}}\right{+}$$

(wherein $R_{25}$ and $R_{26}$ each represents a hydrogen atom, a halogen atom (e.g., fluorine, chlorine, and bromine), a cyano group, a hydroxyl group, or an alkyl group (e.g., methyl, ethyl, and propyl), $\left{+}CH{=}CH\right{+}$,

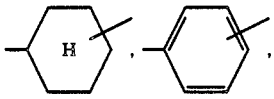

—O—, —S—, $$-\overset{O}{\overset{\|}{C}}-,\ -\underset{R_{27}}{\underset{|}{N}}-,\ -COO-,\ -\overset{S}{\overset{\|}{C}}-,\ -SO_2-,$$

-continued $$-\underset{R_{27}}{\underset{|}{CON}}-,\ -SO_2\underset{R_{27}}{\underset{|}{N}}-,\ -NHCOO-,$$

—NHCONH— and $$-\overset{R_{27}}{\underset{R_{28}}{\overset{|}{\underset{|}{Si}}}}-$$

(wherein $R_{27}$ and $R_{28}$ each represents a hydrogen atom or a hydrocarbon group having the same meaning as defined for $R_{21}$ in the general formula (II) described above), and an appropriate combination thereof.

If the weight average molecular weight of the macromonomer (M) exceeds $2\times10^4$, copolymerizability with other monomers is undesirably reduced. If, on the other hand, it is too small, the effect of improving electrophotographic characteristics of the light-sensitive layer would be small. Accordingly, the macromonomer (M) preferably has a weight average molecular weight of at least $1\times10^3$.

The macromonomer (M) used in the present invention can be produced by a conventionally known synthesis method. More specifically, it can be produced by the method comprising previously protecting the acidic group of a monomer corresponding to the polymerizable component having the specific acidic group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond-containing group into the terminal of the resulting living polymer by a reaction with a various kind of reagent, and then conducting a protection-removing reaction of the functional group which is formed by protecting the acidic group by a hydrolysis reaction, a hydrogenolysis reaction, an oxidative decomposition reaction, or a photodecomposition reaction to form the acidic group.

An example thereof is shown by the following reaction scheme (1):

Reaction Scheme (1)

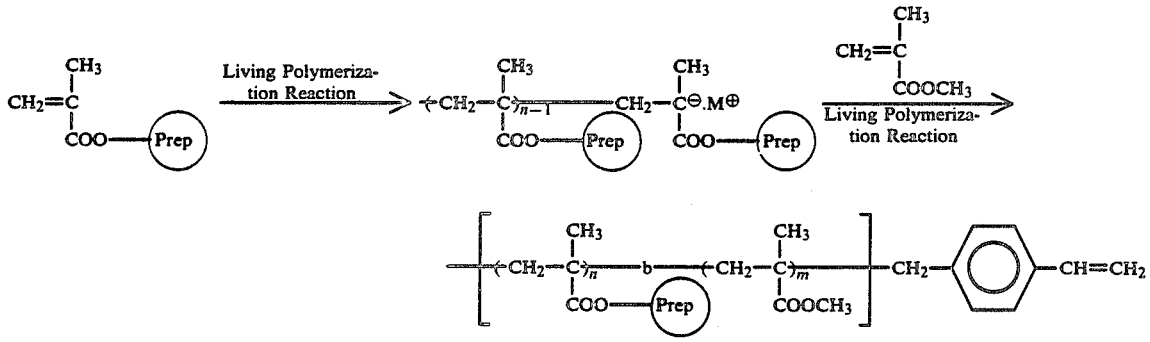

-continued

Reaction Scheme (1)

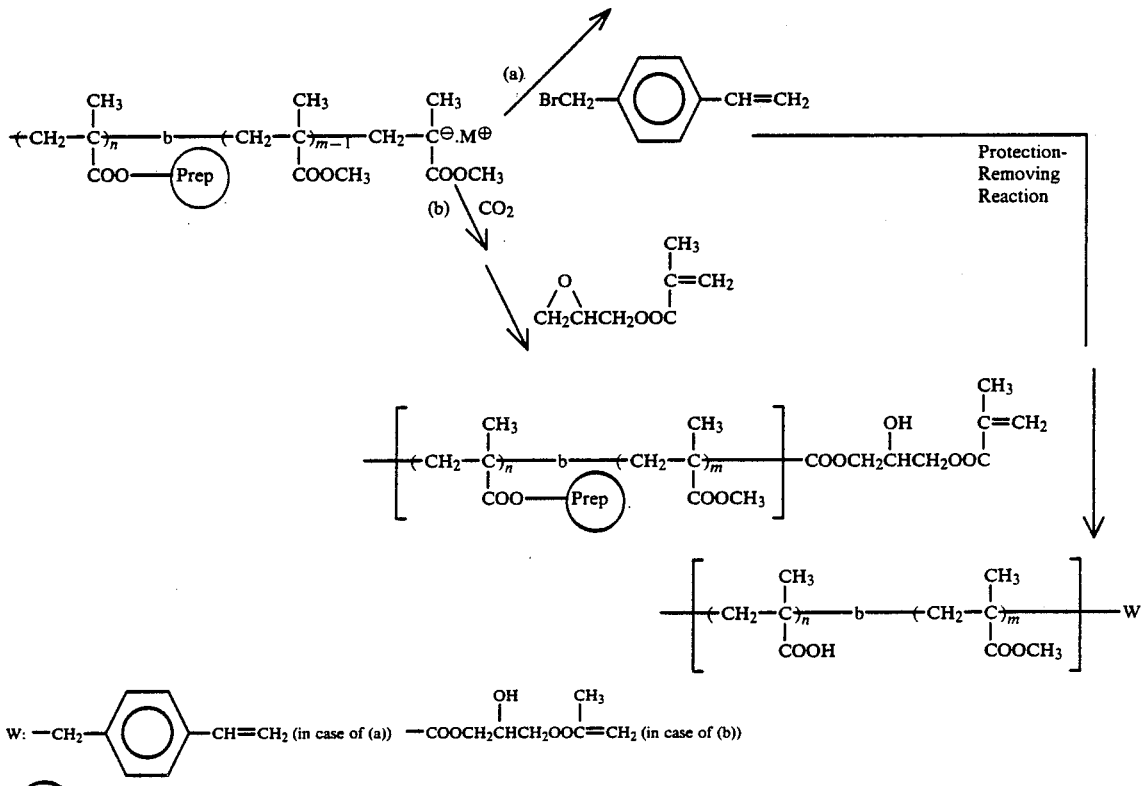

The living polymer can be easily synthesized according to synthesis methods as described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*), 46, 189 (1989), M. Kuroki and T. Aida, *J. Am. Chem. Soc.*, 109, 4737 (1987), Teizo Aida and Shohei Inoue, *Yuki Gosei Kagaku* (*Organic Synthesis Chemistry*), 43, 300 (1985), and D. Y. Sogoh, W. R. Hertler et al, *Macromolecules*, 20, 1473 (1987).

In order to introduce a polymerizable double bond-containing group into the terminal of the living polymer, a conventionally known synthesis method for macromonomer can be employed.

For details, reference can be made, for example, to P. Dreyfuss and R. P. Quirk, *Encycl. Polym. Sci. Eng.*, 7, 551 (1987), P. F. Rempp and E. Franta, *Adv. Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and references cited in these literatures.

Also, the protection of the specific acidic group of the present invention and the release of the protective group (a reaction for removing a protective group) can be easily conducted by utilizing conventionally known techniques. More specifically, they can be performed by appropriately selecting methods as described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973), as well as methods as described in the above references.

Furthermore, the AB block copolymer can be also synthesized by a photoinifeter polymerization method using a dithiocarbamate compound as an initiator. For example, the block copolymer can be synthesized according to synthesis methods as described, e.g., in Takayuki Otsu, *Kobunshi* (*Polymer*), 37, 248 (1988), Shunichi Himori and Ryuichi Ohtsu, Polym. Rep. Jap. 37, 3508 (1988), JP-A-64-111, and JP-A-64-26619.

The macromonomer (M) according to the present invention can be obtained by applying the above described synthesis method for macromonomer to the AB block copolymer.

Specific examples of the macromonomer (M) which can be used in the present invention are set forth below, but the present invention should not be construed as being limited thereto. In the following formulae, $Q_1$, $Q_2$ and $Q_3$ each represents —H, —$CH_3$ or —$CH_2COOCH_3$;

$Q_4$ represents —H or —$CH_3$; $R_{31}$ represents —$C_nH_{2n+1}$ (wherein n represents an integer of from 1 to 18),

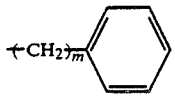

(wherein m represents an integer of from 1 to 3),

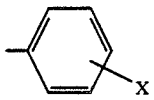

(wherein X represents —H, —Cl, —Br, —$CH_3$, —$OCH_3$ or —$COCH_3$) or

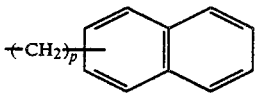

(wherein p represents an integer of from 0 to 3); $R_{32}$ represents —$C_qH_{2q+1}$ (wherein q represents an integer of from 1 to 8) or

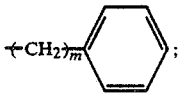

$Y_1$ represents —OH, —COOH, —$SO_3H$,

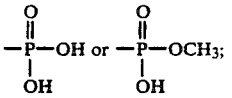

$Y_2$ represents —COOH, —$SO_3H$,

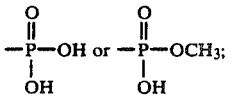

r represents an integer of from 2 to 12; s represents an integer of from 2 to 6; and —b— is as defined above.

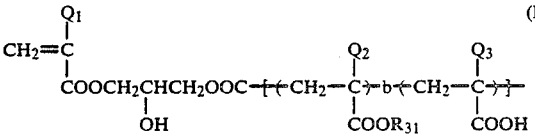

(M-1)

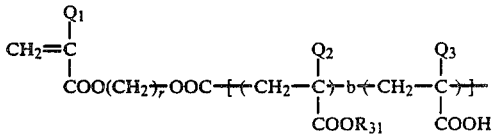

(M-2)

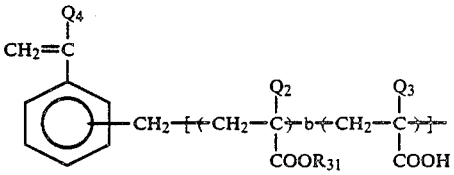

(M-3)

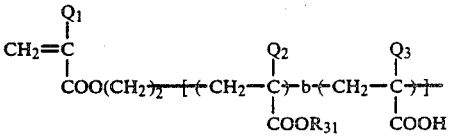

(M-4)

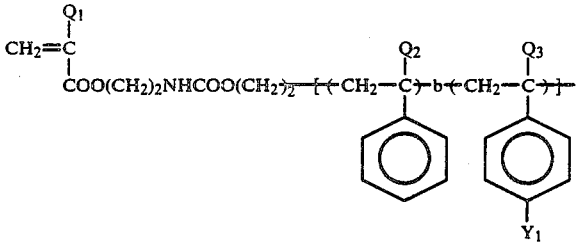

(M-5)

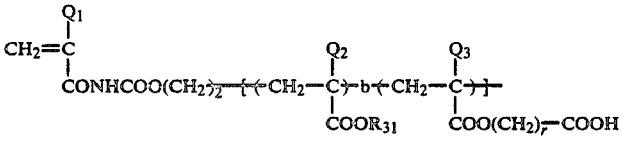

(M-6)

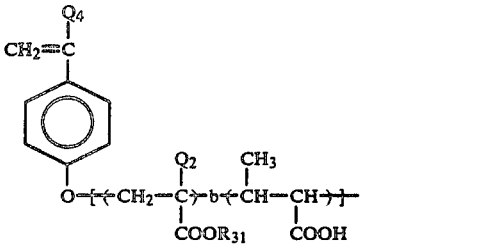

(M-7)

-continued (M-8)

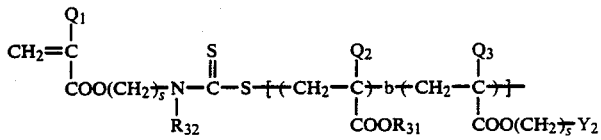

(M-9)

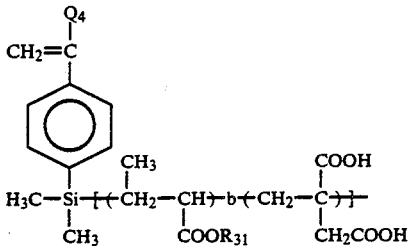

(M-10)

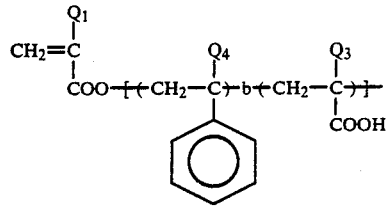

(M-11)

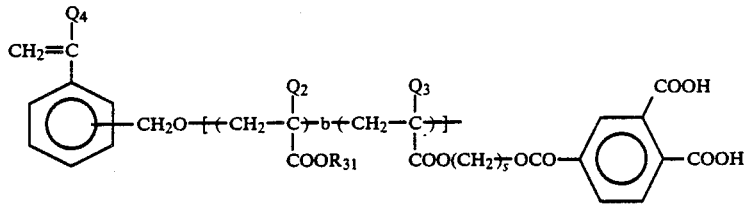

(M-12)

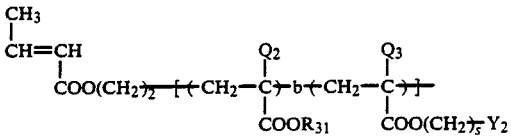

(M-13)

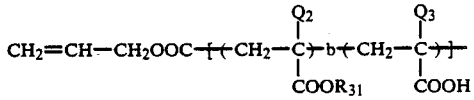

(M-14)

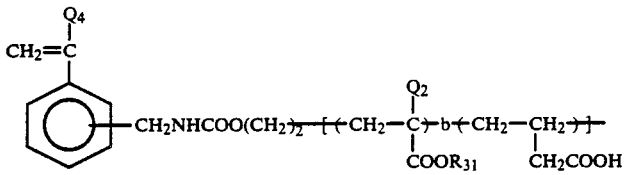

(M-15)

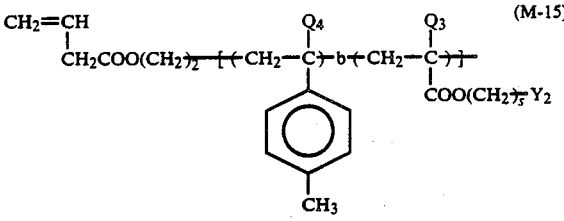

(M-16)

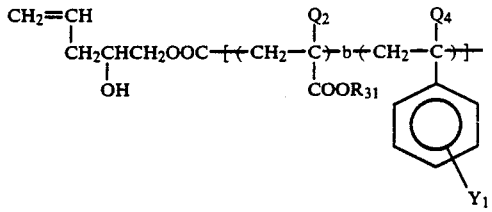

The monomer copolymerizable with the macromonomer (M) described above is preferably selected from those represented by the general formula (III). In the general formula (III), $b_3$, $b_4$, $X_2$ and $R_{22}$ each has the same meaning as defined for $b_1$, $b_2$, $X_1$ and $R_{21}$ in the general formula (II) as described above. More preferably, $b_3$ represents a hydrogen atom, $b_4$ represents a methyl group, and $X_2$ represents —COO—.

In the resin (B) used in the present invention a ratio of the A block to the B block in the macromonomer (M) preferably ranges from 1 to 30/99 to 70 by weight. The content of the acidic group-containing component in the resin (B) is preferably from 0.1 to 20% by weight, more preferably from 0.5 to 10% by weight. A ratio of the copolymerizable component having the macromonomer (M) as a repeating unit to the copolymerizable component having the monomer represented by the general formula (III) as a repeating unit ranges preferably from 1 to 60/99 to 40 by weight, more preferably 5 to 50/95 to 50 by weight.

The binder resins (A) and (B) according to the present invention can be produced by copolymerization of the corresponding mono-functional polymerizable compounds in the desired ratio. The copolymerization can be performed using a known polymerization method, for example, solution polymerization, suspension polymerization, precipitation polymerization, and emulsion polymerization. More specifically, according to the solution polymerization monomers are added to a solvent such as benzene or toluene in the desired ratio and polymerized with an azobis compound, a peroxide compound or a radical polymerization initiator to prepare a copolymer solution. The solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

In the production of the resin (A) ($Mw=1\times10^3$ to $2\times10^4$) and the resin (B) (a graft type copolymer) according to the present invention, the molecular weight thereof can be easily controlled by selecting a kind of initiator (a half-life thereof being varied depending on temperature), an amount of initiator, a starting temperature of the polymerization, and co-use of chain transfer agent, as conventionally known.

As the binder resin of the photoconductive layer according to the present invention, a resin which is conventionally used as a binder resin for electrophotographic light-sensitive materials can be employed in combination with the above described binder resin according to the present invention. Examples of such resins are described, for example, in Harumi Miyamoto and Hidehiko Takei, *Imaging*, Nos. 8 and 9 to 12, 1978 and Ryuji Kurita and Jiro Ishiwata, *Kobunshi* (*Polymer*), 17, 278–284 (1968).

Specific examples thereof include an olefin polymer, an olefin copolymer, a vinyl chloride copolymer, a vinylidene chloride copolymer, a vinyl alkanoate polymer, a vinyl alkanoate copolymer, an allyl alkanoate polymer, an allyl alkanoate copolymer, a styrene and styrene derivative polymer, a styrene and styrene derivative copolymer, a butadiene-styrene copolymer, an isoprene-styrene copolymer, a butadiene-unsaturated carboxylic acid ester copolymer, an acrylonitrile copolymer, a methacrylonitrile copolymer, an alkyl vinyl ether copolymer, acrylic acid ester polymer and copolymer, a methacrylic acid ester polymer and copolymer, a styrene-acrylic acid ester copolymer, a styrene-methacrylic acid ester copolymer, itaconic acid diester polymer and copolymer, a maleic anhydride copolymer, an acrylamide copolymer, a methacrylamide copolymer, a hydroxy group-modified silicone resin, a polycarbonate resin, a ketone resin, an amide resin, a hydroxy group- and carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are a furan ring, a tetrahydrofuran ring, a thiophene ring, a dioxane ring, a dioxolan ring, a lactone ring, a benzofuran ring, a benzothiophene ring, and a 1,3-dioxetane ring), and an epoxy resin.

However, it is preferred that such resins are employed in a range of not more than 30% by weight based on the whole binder resin.

The ratio of the resin (A) to the resin (B) is not particularly restricted, but ranges preferably from 5 to 50/95 to 50 by weight, more preferably from 10 to 40/90 to 60 by weight.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide.

The binder resin is used in a total amount of from 10 to 100 parts by weight, preferably from 15 to 50 parts by weight, per 100 parts by weight of the inorganic photoconductive substance.

If desired, various dyes can be used as spectral sensitizer in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging*, 1973, No. 8, 12, C. J. Young et al., *RCA Review*, 15, 469 (1954), Kohei Kiyota et al., *Denkitsushin Gakkai Ronbunshi*, J 63-C, No. 2, 97 (1980), Yuji Harasaki et al., *Kogyo Kagaku Zasshi*, 66, 78 and 188 (1963), and Tadaaki Tani, *Nihon Shashin Gakkaishi*, 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hammer, *The Cyanine Dyes and Related Compounds*. Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research disclosure*, 216, 117 to 118 (1982).

The light-sensitive material of the present invention is particularly excellent in that the performance properties are not liable to variation even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka*, Chaps. 4 to 6, Nippon Kagaku Joho K.K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin*, 14, No. 1, 2 to 11 (1975), Hiroyuki Moriga, *Nyumon Tokushushi no Kagaku*, Kobunshi Kankokai (1975), and M. F. Hoover, *J. Macromol. Sci. Chem.*, A-4(6), 1327 to 1417 (1970).

In accordance with the present invention, an electrophotographic light-sensitive material which exhibits excellent electrostatic characteristics and mechanical strength even under severe conditions. The electrophotographic light-sensitive material according to the present invention is also advantageously employed in the scanning exposure system using a semiconductor laser beam.

The present invention will now be illustrated in greater detail with reference to the following examples, but it should be understood that the present invention is not to be construed as being limited thereto.

SYNTHESIS EXAMPLE A-1

Synthesis of Resin (A-1)

A mixed solution of 95 g of benzyl methacrylate, 5 g of acrylic acid, and 200 g of toluene was heated to 90° C. in a nitrogen stream, and 6.0 g of 2,2'-azobisisobutyronitrile (hereinafter simply referred to as AIBN) was added thereto to effect reaction for 4 hours. To the reaction mixture was further added 2 g of AIBN, followed by reacting for 2 hours. The resulting copolymer (A-1) had a weight average molecular weight (hereinafter simply referred to as Mw) of 8500.

SYNTHESIS EXAMPLES A-2 TO A-28

Synthesis of Resins (A-2) to (A-28)

Resins (A) shown in Table 1 below were synthesized under the same polymerization conditions as described in Synthesis Example A-1. Each of these resins had an Mw of from $5.0\times10^3$ to $9.0\times10^3$.

TABLE 1

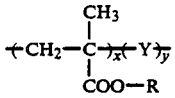

| Synthesis Example No. | Resin (A) | R | Y | x/y (weight ratio) |
|---|---|---|---|---|
| A-2 | A-2 | $-C_2H_5$ | $-CH_2-C(CH_3)(COOH)-$ | 94/6 |
| A-3 | A-3 | $-C_3H_7(n)$ | $-CH_2-CH(COOCH_2CH_2COOH)-$ | 95/5 |
| A-4 | A-4 | $-C_6H_5$ | $-CH_2-CH(COOH)-$ | 95/5 |
| A-5 | A-5 | $-CH_2C_6H_5$ | $-CH_2-C(CH_3)(COOCH_2CH_2-O-P(=O)(OH)-OH)-$ | 97/3 |

TABLE 1-continued
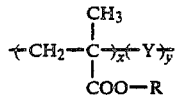
| Synthesis Example No. | Resin (A) | R | Y | x/y (weight ratio) |
|---|---|---|---|---|
| A-6 | A-6 | 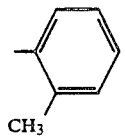 | $-CH_2-CH(COOH)-$ | 95/5 |
| A-7 | A-7 | 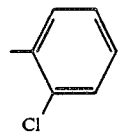 | $-CH_2-C(CH_3)(COO(CH_2)_2OCO(CH_2)_2COOH)-$ | 94/6 |
| A-8 | A-8 | 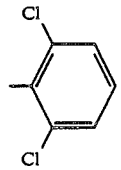 | 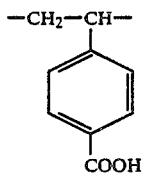 | 95/5 |
| A-9 | A-9 | $-CH_3$ | 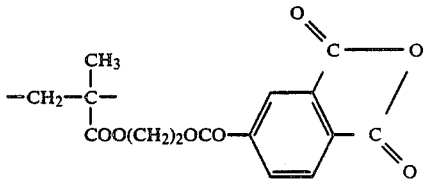 | 93/7 |
| A-10 | A-10 | 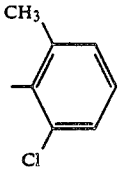 | $-CH_2-CH(COOH)-$ | 95/5 |
| A-11 | A-11 | " | 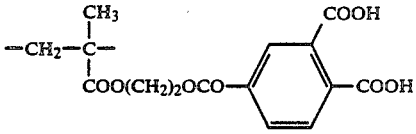 | 96/4 |
| A-12 | A-12 | 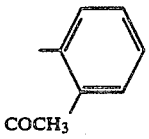 | $-CH_2-CH(CONHCH_2C(CH_3)_2-SO_3H)-$ | 97/3 |
| A-13 | A-13 | 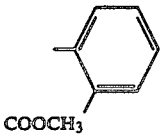 | $-CH_2-C(CH_3)(COO(CH_2)_2O-P(CH_3)(OC_2H_5)-CH_3)-$ | 97/3 |
| A-14 | A-14 | 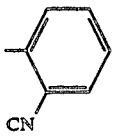 | $-CH_2-CH(CONH(CH_2)_{10}COOH)-$ | 94/6 |

TABLE 1-continued
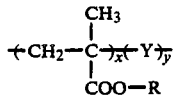
| Synthesis Example No. | Resin (A) | R | Y | x/y (weight ratio) |
|---|---|---|---|---|
| A-15 | A-15 | 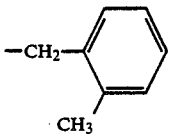 | 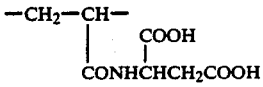 | 97/3 |
| A-16 | A-16 | 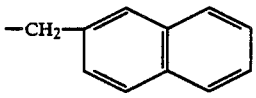 | 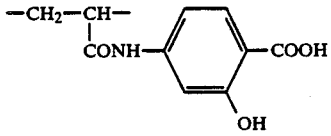 | 95/5 |
| A-17 | A-17 | 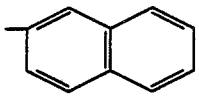 | 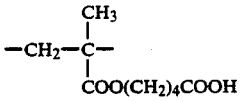 | 93/7 |
| A-18 | A-18 | 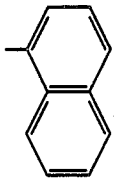 | 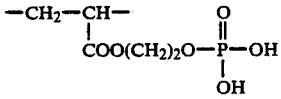 | 97/3 |
| A-19 | A-19 | 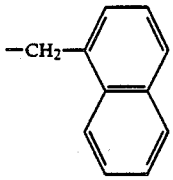 | 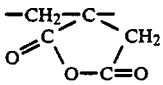 | 95/5 |
| A-20 | A-20 | 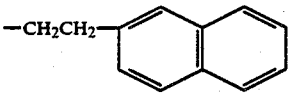 | 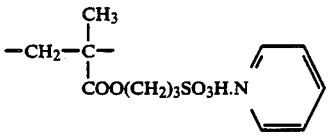 | 98/2 |
| A-21 | A-21 | 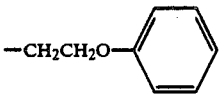 | 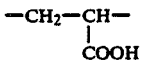 | 96/4 |
| A-22 | A-22 | $-CH_2C_6H_5$ | 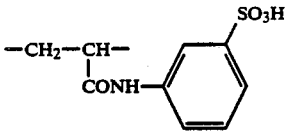 | 97/3 |
| A-23 | A-23 | $-C_2H_5$ | 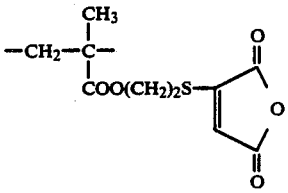 | 96/4 |

TABLE 1-continued

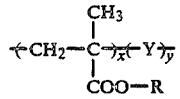

| Synthesis Example No. | Resin (A) | R | Y | x/y (weight ratio) |
|---|---|---|---|---|
| A-24 | A-24 | 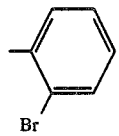 | $-CH_2-CH-$ (COOH) | 95/5 |
| A-25 | A-25 | 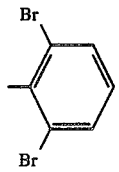 | 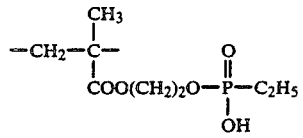 | 92/8 |
| A-26 | A-26 | 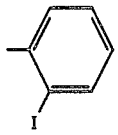 | 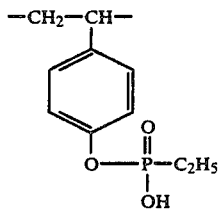 | 97/3 |
| A-27 | A-27 | 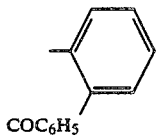 | $-CH_2-CH-$ (COOH) | 95/5 |
| A-28 | A-28 | 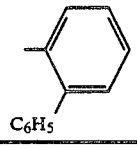 | " | 95/5 |

SYNTHESIS EXAMPLE A-29

Synthesis of Resin (A-29)

A mixed solution of 95 g of 2,6-dichlorophenyl methacrylate, 5 g of acrylic acid, 2 g of n-dodecylmercaptan, and 200 g of toluene was heated to 80° C. in a nitrogen stream, and 2 g of AIBN was added thereto to effect reaction for 4 hours. Then, 0.5 g of AIBN was added thereto, followed by reacting for 2 hours, and thereafter 0.5 g of AIBN was added thereto, followed by reacting for 3 hours. After cooling, the reactive mixture was poured into 2 liters of a solvent mixture of methanol and water (9:1) to reprecipitate, and the precipitate was collected by decantation and dried under reduced pressure to obtain 78 g of the copolymer in the waxy form having an Mw of $6.3\times10^3$.

SYNTHESIS EXAMPLE M-1

Synthesis of Macromonomer (M-1)

A mixed solution of 10 g of triphenylmethyl methacrylate, and 200 g of toluene was sufficiently degassed in a nitrogen stream and cooled to −20° C. Then, 0.02 g of 1,1-diphenylbutyl lithium was added to the mixture, and the reaction was conducted for 10 hours. Separately, a mixed solution of 90 g of ethyl methacrylate and 100 g of toluene was sufficiently degassed in a nitrogen stream and the resulting mixed solution was added to the above described mixture, and then reaction was further conducted for 10 hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 10 g of dicyclohexylcarbodiimide, 0.2 g of 4-N,N-dimethylaminopyridine and 30 g of methylene chloride was added dropwise thereto over a period of 30 minutes, and the mixture was stirred for 3 hours.

After removing the insoluble substances from the reaction mixture by filtration, 10 ml of an ethanol solution of 30% by weight hydrogen chloride was added to the filtrate and the mixture was stirred for one hour. Then, the solvent of the reaction mixture was distilled off under reduced pressure until the whole volume was reduced to a half, and the mixture was reprecipitated from one liter of petroleum ether.

The precipitates thus formed were collected and dried under reduced pressure to obtain 56 g of Macromonomer (M-1) shown below having an Mw of $6.5\times10^3$.

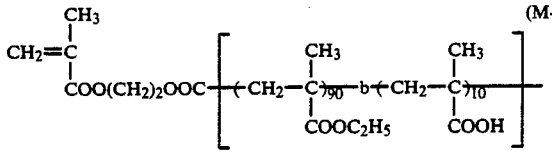

(M-1)

SYNTHESIS EXAMPLE M-2

Synthesis of Macromonomer (M-2)

A mixed solution of 5 g of benzyl methacrylate, 0.01 g of (tetraphenyl porphinate) aluminum methyl, and 60 g of methylene chloride was raised to a temperature of 30° C. in a nitrogen stream. The mixture was irradiated with light from a xenon lamp of 300 W at a distance of 25 cm through a glass filter, and the reaction was conducted for 12 hours. To the mixture was further added 45 g of butyl methacrylate, after similarly light-irradiating for 8 hours, 5 g of 4-bromomethylstyrene was added to the reaction mixture followed by stirring for 30 minutes, then the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates thus formed were collected and dried to obtain 33 g of Macromonomer (M-2) shown below having an Mw of $7\times10^3$.

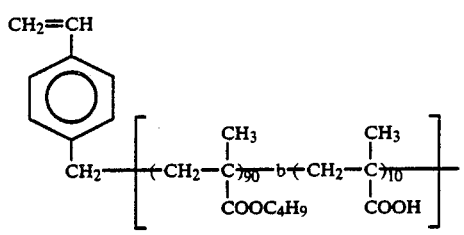

(M-2)

SYNTHESIS EXAMPLE M-3

Synthesis of Macromonomer (M-3)

A mixed solution of 20 g of 4-vinylphenyloxytrimethylsilane and 100 g of toluene was sufficiently degassed in a nitrogen stream and cooled to 0° C. Then, 0.1 g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed in a nitrogen stream and the resulting mixed solution was added to the above described mixture, and then reaction was further conducted for 8 hours. After introducing ethylene oxide in a flow rate of 30 ml/min into the reaction mixture for 30 minutes with vigorously stirring, the mixture was cooled to a temperature of 15° C., and 8 g of methacrylic chloride was added dropwise thereto over a period of 30 minutes, followed by stirring for 3 hours.

Then, to the reaction mixture was added 10 ml of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of Macromonomer (M-3) shown below having an Mw of $7.8\times10^3$.

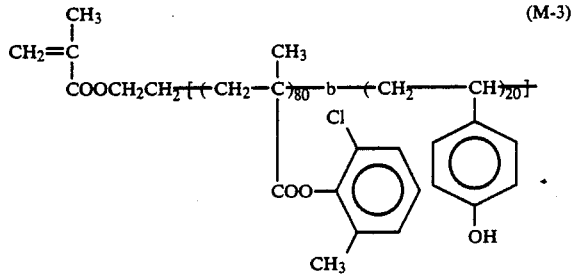

(M-3)

SYNTHESIS EXAMPLE M-4

Synthesis of Macromonomer (M-4)

A mixed solution of 15 g of triphenylmethyl acrylate and 100 g of toluene was sufficiently degassed in a nitrogen stream and cooled to −20° C. Then, 0.1 g of sec-butyl lithium was added to the mixture, and the reaction was conducted for 10 hours. Separately, a mixed solution of 85 g of styrene and 100 g of toluene was sufficiently degassed in a nitrogen stream and the resulting mixed solution was added to the above described mixture, and then reaction was further conducted for 12 hours. The reaction mixture was adjusted to 0° C., 8 g of benzyl bromide was added thereto, and the reaction was conducted for one hour, followed by reacting at 25° C. for 2 hours.

Then, to the reaction mixture was added 10 ml of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of Macromonomer (M-4) shown below having an Mw of $4.5\times10^3$.

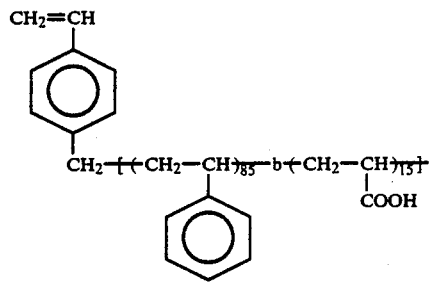

(M-4)

SYNTHESIS EXAMPLE M-5

Synthesis of Macromonomer (M-5)

A mixed solution of 80 g of phenyl methacrylate and 4.8 g of benzyl N-hydroxyethyl-N-ethyldithiocarbamate was placed in a vessel in a nitrogen stream followed by closing the vessel and heated to 60° C. The mixture was irradiated with light from a high-pressure mercury lamp for 400 W at a distance of 10 cm through a glass filter for 10 hours to conduct a photopolymerization.

Then, 20 g of acrylic acid and 180 g of methyl ethyl ketone were added to the mixture and, after replacing the gas in the vessel with nitrogen, the mixture was light-irradiated again for 10 hours.

To the reaction mixture was added dropwise 6 g of 2-isocyanatoethyl methacrylate at 30° C. over a period of one hour and the mixture was stirred for 2 hours. The reaction mixture was reprecipitated from 1.5 liters of hexane and the precipitates thus formed were collected and dried to obtain 68 g of Macromonomer (M-5) shown below having an Mw of $6.0\times10^3$.

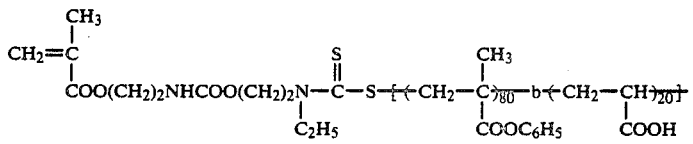

(M-5)

SYNTHESIS EXAMPLE B-1

Synthesis of Resin (B-1)

A mixed solution of 80 g of ethyl methacrylate, 20 g of Macromonomer (M-1) and 150 g of toluene was heated at 85° C. in a nitrogen stream, and 0.8 g of 1,1-azobis(cyclohexane-1-carbonitrile) (hereinafter simply referred to as ABCC) to effect reaction for 5 hours. Then, 0.5 g of ABCC was further added thereto, followed by reacting for 5 hours. The resulting copolymer shown below had an Mw of $1.0\times10^5$.

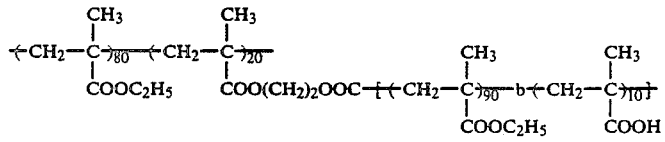

(B-1)

SYNTHESIS EXAMPLE B-2

Synthesis of Resin (B-2)

A mixed solution of 70 g of ethyl methacrylate, 30 g of Macromonomer (M-1), and 150 g of toluene was heated at 70° C. in a nitrogen stream, and 0.5 g of AIBN was added thereto to effect reaction for 6 hours. Then, 0.3 g of AIBN was further added, followed by reacting for 4 hours and thereafter 0.3 g of AIBN was further added, followed by reacting for 4 hours. The resulting copolymer shown below had an Mw of $8.5\times10^4$.

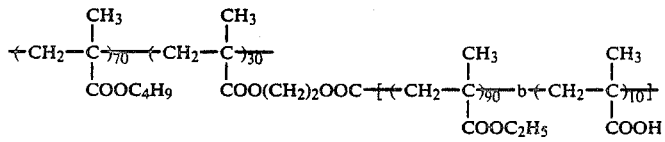

(B-2)

SYNTHESIS EXAMPLES B-3 TO B-9

Synthesis of Resins (B-3) to (B-9)

Resins (B) shown in Table 2 below were synthesized under the same polymerization conditions as described in Synthesis Example B-2. Each of these resins had an Mw of from $7\times10^4$ to $9\times10^4$.

TABLE 2
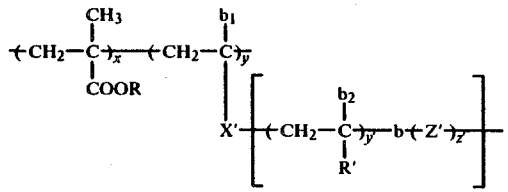
| Synthesis Example No. | Resin (B) | —R | —X'— | x/y | $b_1/b_2$ | —R' | —Z' | y'/z' |
|---|---|---|---|---|---|---|---|---|
| 3 | B-3 | $-CH_3$ | $-COO(CH_2)_2OOC-$ | 90/10 | $-CH_3/-CH_3$ | $-COOC_4H_9$ | $-CH_2-C(CH_3)(COOH)-$ | 90/10 |
| 4 | B-4 | $-C_3H_7(n)$ | 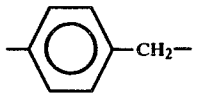 | 80/20 | $-H/-CH_3$ | $-COOC_2H_5$ | 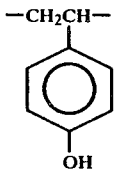 | 80/20 |
| 5 | B-5 | $-CH_2C_6H_5$ | $-COO(CH_2)_2-$ | 90/10 | $-H/-CH_3$ | $-OC_2H_5$ | $-CH_2-C(CH_3)(COO(CH_2)_4SO_3H)-$ | 95/5 |
| 6 | B-6 | $-C_2H_5$ | $-COO-$ | 90/10 | $-CH_3/-CH_3$ | $-COOC_2H_5$ | $-CH_2-CH(COOH)-$ | 90/10 |
| 7 | B-7 | " | $-COO(CH_2)_2NHCOO-$ 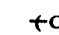 | 90/10 | $-CH_3/-H$ | $-COOC_3H_7$ | 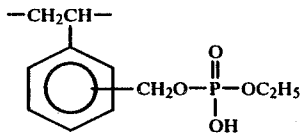 | 85/15 |
| 8 | B-8 | $-CH_2C_6H_5$ | 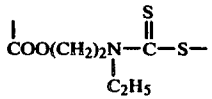 | 90/10 | $-H/-CH_3$ | $-COOC_2H_5$ | 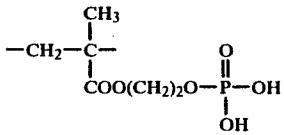 | 92/8 |

TABLE 2-continued
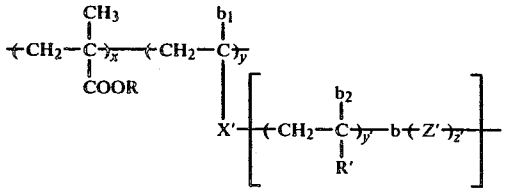
| Synthesis Example No. | Resin (B) | —R | —X'— | x/y | $b_1/b_2$ | —R' | —Z' | y'/z' |
|---|---|---|---|---|---|---|---|---|
| 9 | B-9 | $-C_2H_5$ | —COO— | 85/15 | —H/—H | 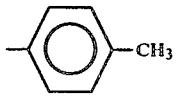 | 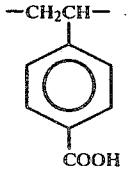 | 90/10 |

SYNTHESIS EXAMPLES B-10 TO B-20

Synthesis of Resins (B-10) to (B-20)

Resins (B) shown in Table 3 below were synthesized under the same polymerization conditions as described in Synthesis Example B-1. Each of these resins had an Mw of from $9\times10^4$ to $2\times10^5$.

TABLE 3

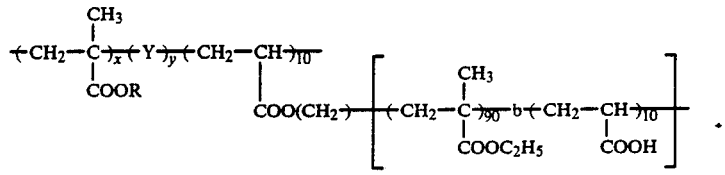

x + y + 10 = 100 (by weight)

| Synthesis Example No. | Resin (B) | —R | —Y— | x/y |
|---|---|---|---|---|
| 10 | B-10 | $-C_2H_5$ | $-CH_2-CH(COOCH_3)-$ | 70/20 |
| 11 | B-11 | $-CH_3$ | $-CH_2-CH(COOC_2H_5)-$ | 75/15 |
| 12 | B-12 | $-C_4H_9$ | $-CH_2-CH(C_6H_5)-$ | 70/20 |
| 13 | B-13 | " | $-CH_2-CH(CN)-$ | 80/10 |
| 14 | B-14 | $-C_4H_9$ | $-CH_2-CH(COO(CH_2)_2CN)-$ | 75/15 |
| 15 | B-15 | $-CH_2C_6H_5$ | $-CH_2-C(CH_3)(COO(CH_2)_2OH)-$ | 80/10 |
| 16 | B-16 | $-C_2H_5$ | $-CH_2-CH(CONH_2)-$ | 85/5 |
| 17 | B-17 | $-C_2H_5$ | $-CH_2-C(CH_3)(COO(CH_2)_2N\langle O\rangle)-$ | 85/5 |
| 18 | B-18 | $-C_2H_5$ | $-CH_2-CH(C_6H_4-CH_3)-$ | 75/15 |
| 19 | B-19 | $C_6H_4-CH_3$ | $-CH_2-C(CH_3)(COOC_2H_5)-$ | 70/20 |

TABLE 3-continued

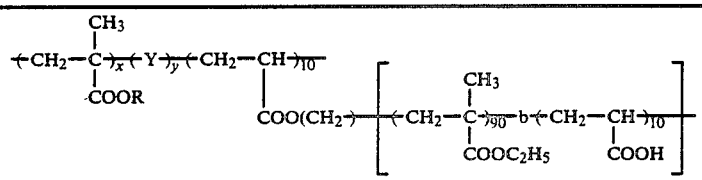

x + y + 10 = 100 (by weight)

| Synthesis Example No. | Resin (B) | —R | —Y— | x/y |
|---|---|---|---|---|
| 20 | B-20 | 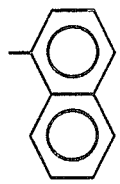 | $-CH_2-CH-$ (COOC$_2$H$_5$) | 70/20 |

EXAMPLE 1

A mixture of 6 g (solid basis, hereinafter the same) of Resin (A-7), 34 g (solid basis, hereinafter the same) of Resin (B-1), 200 g of zinc oxide, 0.018 g of Cyanine Dye (I) shown below, 0.15 g of salicylic acid, and 300 g of toluene was dispersed in a ball mill for 3 hours to prepare a coating composition for a light-sensitive layer. The coating composition was coated on paper subjected to electrically conductive treatment, with a wire bar at a dry coverage of 20 g/m$^2$, followed by drying at 110° C. for 30 seconds. The coated material was then allowed to stand in a dark place at 20° C. and 65% RH (relative humidity) for 24 hours to prepare an electrophotographic light-sensitive material.

Cyanine Dye (I):

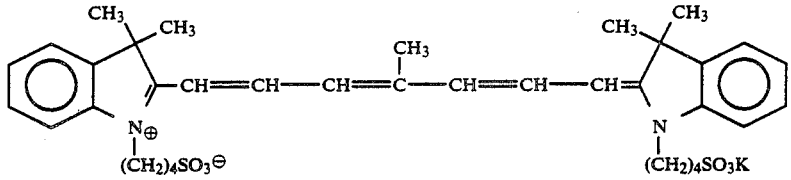

COMPARATIVE EXAMPLE A

An electrophotographic light-sensitive material was prepared in the same manner as in Example 1, except for using 34 g of poly(ethyl methacrylate) having an Mw of $2.4\times10^5$ (Resin (R-1)) in place of 34 g of Resin (B-1).

COMPARATIVE EXAMPLE B

An electrophotographic light-sensitive material was prepared in the same manner as in Example 1, except for using 34 g of ethyl methacrylate/methacrylic acid copolymer (99.5/0.5 in weight ratio) having an Mw of $9\times10^4$ (Resin (R-2)) in place of 34 g of Resin (B-1).

Each of the light-sensitive materials obtained in Example 1 and Comparative Examples A and B was evaluated for film properties in terms of surface smoothness and mechanical strength; electrostatic characteristics; image forming performance; and image forming performance under conditions of 30° C. and 80% RH; oil-desensitivity when used as an offset master plate precursor (expressed in terms of contact angle of the layer with water after oil-desensitization treatment); and printing suitability (expressed in terms of background stain and printing durability) according to the following test methods. The results obtained are shown in Table 4 below.

1) Smoothness of Photoconductive Layer

The smoothness (sec/cc) was measured using a Beck's smoothness tester (manufactured by Kumagaya Riko K.K.) under an air volume condition of 1 cc.

2) Mechanical Strength of Photoconductive Layer

The surface of the light-sensitive material was repeatedly (1000 times) rubbed with emery paper (#1000) under a load of 60 g/cm$^2$ using a Heidon 14 Model surface testing machine (manufactured by Shinto Kagaku K.K.). After dusting, the abrasion loss of the photoconductive layer was measured to obtain film retention (%).

3) Electrostatic Characteristics

The sample was charged with a corona discharge to a voltage of −6 kV for 20 seconds in a dark room at 20° C. and 65% RH using a paper analyzer ("Paper Analyzer SP-428" manufactured by Kawaguchi Denki K.K.). Ten seconds after the corona discharge, the surface potential $V_{10}$ was measured. The sample was allowed to stand in the dark for an additional 180 seconds, and the potential $V_{190}$ was measured. The dark decay retention rate (DRR; %), i.e., percent retention of potential after dark decay for 180 seconds, was calculated from the following equation:

$$DRR\ (\%)=(V_{190}/V_{10})\times 100$$

Separately, the sample was charged to −500 V with a corona discharge and then exposed to monochromatic light having a wavelength of 785 nm, and the time required for decay of the surface potential $V_{10}$ to one-tenth was measured to obtain an exposure $E_{1/10}$ (erg/cm$^2$).

Further, the sample was charged to −500 V with a corona discharge in the same manner as described for the measurement of $E_{1/10}$, then exposed to monochromatic light having a wavelength of 785 nm, and the time required for decay of the surface potential $V_{10}$ to one-hundredth was measured to obtain an exposure $E_{1/100}$ (erg/cm$^2$).

The measurements were conducted under conditions of 20° C. and 65% RH (hereinafter referred to as Condition I) or 30° C. and 80% RH (hereinafter referred to as Condition II).

4) Image Forming Performance

After the samples were allowed to stand for one day under Condition I or II, each sample was charged to −5 kV and exposed to light emitted from a gallium-aluminum-arsenic semi-conductor laser (oscillation wavelength: 780 nm; output: 2.8 Mw) at an exposure amount of 50 erg/cm$^2$ (on the surface of the photoconductive layer) at a pitch of 25 μm and a scanning speed of 330 m/sec. The thus formed electrostatic latent image was developed with a liquid developer ("ELP-T" produced by Fuji Photo Film Co., Ltd.), followed by fixing. The duplicated image was visually evaluated for fog and image quality.

5) Contact Angle With Water

The sample was passed once through an etching processor using an oil-desensitizing solution ("ELP-EX" produced by Fuji Photo Film Co., Ltd.) diluted to a two-fold volume with distilled water to render the surface of the photoconductive layer oil-desensitive. On the thus oil-desensitized surface was placed a drop of 2 μl of distilled water, and the contact angle formed between the surface and water was measured using a goniometer.

6) Printing Durability

The sample was processed in the same manner as described in 4) above to form toner images, and the surface of the photoconductive layer was subjected to oil-desensitization treatment under the same conditions as in 5) above. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

TABLE 4

| | Example 1 | Comparison Example A | Comparison Example B |
|---|---|---|---|
| Surface Smoothness (sec/cc) | 135 | 140 | 120 |
| Film Strength (%) | 98 | 92 | 95 |
| Electrostatic Characteristics: | | | |
| $V_{10}$ (−V): | | | |
| Condition I | 630 | 630 | 635 |
| Condition II | 620 | 610 | 620 |
| DRR (%): | | | |
| Condition I | 85 | 86 | 85 |
| Condition II | 83 | 80 | 82 |
| $E_{1/10}$ (erg/cm$^2$): | | | |
| Condition I | 32 | 34 | 32 |
| Condition II | 33 | 38 | 34 |
| $E_{1/100}$ (erg/cm$^2$): | | | |
| Condition I | 47 | 65 | 68 |
| Condition II | 50 | 90 | 88 |
| Image-Forming Performance: | | | |
| Condition I | Very good | Poor (slight scratches of fine lines) | Poor (slight scratches of fine lines) |
| Condition II | Very good | Poor (slight scratches of fine lines) | Poor (slight scratches of fine lines) |
| Contact Angle With Water (°) | 10 or less | 10 or less | 10 |
| Printing Durability: | 10,000 or more | 4,000 | 8,000 |

As can be seen from the results shown in Table 4, the light-sensitive material according to the present invention had good surface smoothness, film strength and electrostatic characteristics. The duplicated image was clear and free from background fog in the non-image area. While the reason therefor has not been proven conclusively, these results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic, as shown by a small contact angle of 10° C. or less with water. On practical printing using the resulting master plate, no background stains were observed in the prints.

The sample of Comparative Examples A and B had almost satisfactory values on the electrostatic characteristics of $V_{10}$, DRR and $E_{1/10}$ under the normal condition. However, with respect to $E_{1/100}$, the values obtained were much greater than the value of the light-sensitive material according to the present invention. Further, under the conditions of high temperature and high humidity, $E_{1/100}$ value was further increased.

The value of $E_{1/100}$ indicated an electrical potential remaining in the non-image areas after exposure at the practice of image formation. The smaller this value, the less the background stains in the non-image areas. More specifically, it is requested that the remaining potential is decreased to −10 V or less. Therefore, an amount of exposure necessary to make the remaining potential below −10 V is an important factor. In the scanning exposure system using a semiconductor laser beam, it is quite important to make the remaining potential below −10 V by a small exposure amount in view of a design for an optical system of a duplicator (such as cost of the device, and accuracy of the optical system).

When the samples of Comparative Examples A and B were actually imagewise exposed by a device of a small amount of exposure, the occurrence of scratches of fine lines in the image areas and background fog in the non-image areas was observed.

Furthermore, when used as an offset master plate precursor, the printing durability was 4,000 prints (Comparative Example A) or 8,000 prints (Comparative Example B) under the printing conditions under which the sample according to the present invention provided more than 10,000 prints of good quality.

From all these considerations, it is thus clear that an electrophotographic light-sensitive material satisfying both requirements of electrostatic characteristics and printing suitability can be obtained only using the binder resin according to the present invention.

EXAMPLES 2 TO 17

An electrophotographic light-sensitive material was prepared in the same manner as described in Example 1, except for replacing Resin (A-7) and Resin (B-1) with each of Resins (A) and (B) shown in Table 5 below, respectively.

The performance properties of the resulting light-sensitive materials were evaluated in the same manner as described in Example 1. The results obtained are shown in Table 5 below. The electrostatic characteristics in Table 5 are those determined under Condition II (30° C. and 80% RH).

TABLE 5

| Example No. | Resin (A) | Resin (B) | $V_{10}$ (−V) | DRR (%) | $E_{1/10}$ (erg/cm$_2$) | $E_{1/100}$ (erg/cm$_2$) |
|---|---|---|---|---|---|---|
| 2 | A-2 | B-1 | 460 | 73 | 45 | 55 |
| 3 | A-3 | B-5 | 465 | 75 | 43 | 55 |
| 4 | A-4 | B-5 | 550 | 78 | 36 | 49 |
| 5 | A-8 | B-11 | 600 | 85 | 32 | 45 |
| 6 | A-10 | B-13 | 600 | 83 | 30 | 43 |
| 7 | A-12 | B-16 | 560 | 80 | 35 | 42 |
| 8 | A-16 | B-17 | 550 | 78 | 38 | 46 |
| 9 | A-17 | B-18 | 580 | 85 | 30 | 40 |
| 10 | A-18 | B-19 | 570 | 80 | 35 | 43 |
| 11 | A-19 | B-20 | 555 | 80 | 36 | 45 |
| 12 | A-22 | B-2 | 550 | 78 | 38 | 46 |
| 13 | A-24 | B-3 | 565 | 79 | 36 | 45 |
| 14 | A-25 | B-4 | 570 | 80 | 37 | 43 |
| 15 | A-27 | B-8 | 555 | 80 | 36 | 42 |
| 16 | A-29 | B-9 | 580 | 83 | 30 | 41 |
| 17 | A-20 | B-10 | 540 | 76 | 40 | 56 |

Further, when these electrophotographic light-sensitive materials were employed as offset master plate precursors under the same printing condition as described in Example 1, more than 10,000 prints of good quality were obtained respectively.

It can be seen from the results described above that each of the light-sensitive materials according to the present invention was satisfactory in all aspects of photoconductive layer surface smoothness, film strength, electrostatic characteristics, and printing suitability.

Further, it can be seen that the electrostatic characteristics are further improved by the use of the resin (A').

EXAMPLES 18 TO 27

An electrophotographic light-sensitive material was prepared in the same manner as described in Example 1, except for replacing 6 g of Resin (A-7) with 7.6 g each of Resins (A) shown in Table 6 below, replacing 34 g of Resin (B-1) with 34 g each of Resins (B) shown in Table 6 below, and replacing 0.018 g of Cyanine Dye (I) with 0.019 g of Cyanine Dye (II) shown below.

Cyanine Dye (II):

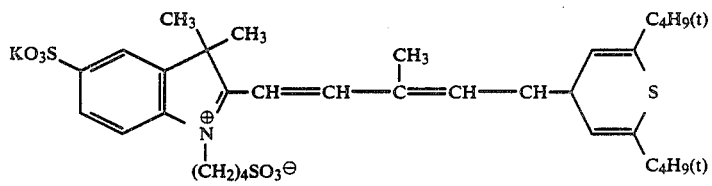

TABLE 6

| Example No. | Resin (A) | Resin (B) |
|---|---|---|
| 18 | A-2 | B-9 |
| 19 | A-3 | B-16 |
| 20 | A-7 | B-4 |
| 21 | A-9 | B-14 |
| 22 | A-28 | B-17 |
| 23 | A-15 | B-13 |
| 24 | A-16 | B-11 |
| 25 | A-21 | B-15 |
| 26 | A-23 | B-18 |
| 27 | A-26 | B-20 |

As the results of the evaluation as described in Example 1, it can be seen that each of the light-sensitive materials according to the present invention is excellent in charging properties, dark charge retention, and photosensitivity, and provides a clear duplicated image free from background fog even when processed under severe conditions of high temperature and high humidity (30° C. and 80% RH). Further, when these materials were employed as offset master plate precursors, more than 10,000 prints of a clear image free from background stains were obtained respectively.

EXAMPLES 28 TO 29

A mixture of 6.5 g of Resin (A-2) (Example 28) or Resin (A-10) (Example 29), 33.5 g of Resin (B-2), 200 g of zinc oxide, 0.02 g of uranine, 0.04 g of Rose Bengale, 0.03 g of bromophenol blue, 0.20 g of phthalic anhydride, and 300 g of toluene was dispersed in a ball mill for 3 hours to prepare a coating composition for a light-sensitive layer. The coating composition was coated on paper, which had been subjected to electrically conductive treatment, with a wire bar at a dry coverage of 20 g/m$^2$, and dried for one minute at 110° C. Then, the coated material was allowed to stand in a dark place for 24 hours under the conditions of 20° C. and 65% RH to prepare each electrophotographic light-sensitive material.

COMPARATIVE EXAMPLE C

An electrophotographic light-sensitive material was prepared in the same manner as in Example 28, except for using 33.5 g of Resin (R-2) described above in place of 33.5 g of Resin (B-2).

Each of the light-sensitive materials obtained in Examples 28 and 29 and Comparative Example C was evaluated in the same manner as in Example 1, except that the electrostatic characteristics and image forming performance were evaluated according to the following test methods.

7) Electrostatic Characteristics $E_{1/10}$ and $E_{1/100}$

The surface of the photoconductive layer was charged to −400 V with corona discharge, then irradiated by visible light of the illuminance of 2.0 lux, the time required for decay of the surface potential ($V_{10}$) to 1/10 or 1/100 thereof, and the exposure amount $E_{1/10}$ or $E_{1/100}$ (lux·sec) was calculated therefrom.

8) Image Forming Performance

Each electrophotographic light-sensitive material was allowed to stand for one day under the environmental conditions of 20° C. and 65% RH (Condition I) or 30° C. and 80% RH (Condition II), the light-sensitive material was image exposed and developed by a full-automatic plate making machine (ELP-404V made by Fuji Photo Film Co., Ltd.) using ELP-T as a toner. The duplicated image thus obtained was visually evaluated for fog and image quality. The original used for the duplication was composed of cuttings of other originals pasted up thereon.

The results obtained are shown in Table 7 below.

From the results shown in Table 7 above, it can be seen that each light-sensitive material exhibits almost the same properties with respect to the surface smoothness and mechanical strength of the photoconductive layer. However, on the electrostatic characteristics, the sample of Comparative Example C has a layer value of $E_{1/100}$, particularly under the high temperature and high humidity conditions. On the contrary, the electrostatic characteristics of the light-sensitive material according to the present invention are good. Further, those of Example 29 using the resin (A) having the specific substituent are very good. The value of $E_{1/100}$ is particularly small.

With respect to image-forming performance, the edge mark of cuttings pasted up was observed as background fog in the non-image areas in the sample of Comparative Example C. On the contrary, the samples according to the present invention provided clear duplicated images free from background fog.

Further, each of these samples was subjected to the oil-desensitization to prepare an offset printing plate and printing was conducted. The samples according to the present invention provided 10,000 prints of clear image without background stains. However, with the sample of Comparative Example C, the above described edge mark of cuttings pasted up was not removed with the oil-desensitizing treatment and the background stains occurred from the start of printing.

As can be seen from the above results, only the light-sensitive material according to the present invention can provide the excellent performance.

EXAMPLES 30 TO 41

An electrophotographic light-sensitive material was prepared in the same manner as described in Example 28, except for replacing 6.5 g Resin (A-2) with 6.5 g of each of Resins (A) shown in Table 8 below, replacing

TABLE 7

| | Example 28 | Example 29 | Comparative Example C |
|---|---|---|---|
| Binder Resin | (A-2)/(B-2) | (A-10)/(B-2) | (A-2)/(R-2) |
| Surface Smoothness (sec/cc) | 135 | 135 | 130 |
| Film Strength (%) | 98 | 97 | 92 |
| Electrostatic Characteristics: | | | |
| $V_{10}$ (−V): | | | |
| Condition I | 540 | 630 | 540 |
| Condition II | 530 | 620 | 530 |
| DRR (%): | | | |
| Condition I | 90 | 96 | 90 |
| Condition II | 85 | 94 | 86 |
| $E_{1/10}$ (erg/cm$^2$): | | | |
| Condition I | 11.5 | 9.5 | 12.8 |
| Condition II | 10.3 | 9.0 | 10.0 |
| $E_{1/100}$ (erg/cm$^2$): | | | |
| Condition I | 28 | 20 | 45 |
| Condition II | 30 | 23 | 50 |
| Image-Forming Performance: | | | |
| Condition I | Good | Very good | Poor (edge mark of cuttings) |
| Condition II | Good | Very good | Poor (severe edge mark of cuttings) |
| Contact Angle With Water (°) | 10 or less | 10 or less | 10 or less |
| Printing Durability: | 10,000 | 10,000 | Background stains due to edge mark of cutting from the start of printing |

33.5 g of Resin (B-2) with 33.5 g of each of Resins (B) shown in Table 8 below.

TABLE 8

| Example No. | Resin (A) | Resin (B) |
|---|---|---|
| 30 | A-1 | B-1 |
| 31 | A-4 | B-1 |
| 32 | A-5 | B-2 |
| 33 | A-7 | B-4 |
| 34 | A-9 | B-5 |
| 35 | A-11 | B-7 |
| 36 | A-12 | B-9 |
| 37 | A-14 | B-10 |
| 38 | A-23 | B-13 |
| 39 | A-25 | B-15 |
| 40 | A-26 | B-19 |
| 41 | A-29 | B-20 |

As the results of the evaluation as described in Example 28, it can be seen that each of the light-sensitive materials according to the present invention is excellent in charging properties, dark charge retention rate, and photosensitivity, and provides a clear duplicated image free from background fog and scratches of fine lines even when processed under severe conditions of high temperature and high humidity (30° C. and 80% RH). Further, when these materials were employed as offset master plate precursors, 10,000 prints of a clear image free from background stains were obtained respectively.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon at least one photoconductive layer containing an inorganic photoconductive substance and a binder resin, wherein the binder resin comprises (A) at least one resin having a weight average molecular weight of from $1\times10^3$ to $2\times10^4$ and containing not less than 30% by weight of a copolymerizable component corresponding to a repeating unit represented by the general formula (I) described below and from 0.5 to 20% by weight of a copolymerizable component having at least one acidic group selected from the group consisting of $-PO_3H_2$, $-SO_3H$, —COOH, —OH,

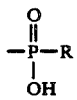

(wherein R represents a hydrocarbon group or —OR' (wherein R' represents a hydrocarbon group)) and a cyclic acid anhydride-containing group;

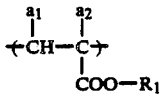

(I)

wherein $a_1$ and $a_2$ each represents a hydrogen atom, a halogen atom, a cyano group or hydrocarbon group; and $R_1$ represents a hydrocarbon group; and (B) at least one graft type copolymer having a weight average molecular weight of from $3\times10^4$ to $1\times10^6$ and containing, as a copolymerizable component, at least one mono-functional macromonomer (M) having a weight average molecular weight of from $1\times10^3$ to $2\times10^4$ and comprising an AB block copolymer being composed of an A block comprising at least one polymerizable component containing at least one acidic group selected from $-PO_3H_2$, —COOH, $-SO_3H$, a phenolic hydroxyl group,

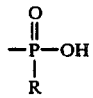

(wherein R represents a hydrocarbon group or —OR' (wherein R' represents a hydrocarbon group)) and a cyclic acid anhydride-containing group, and a B block containing at least one polymerizable component represented by the general formula (II) described below and having a polymerizable double bond group bonded to the terminal of the main chain of the B block polymer;

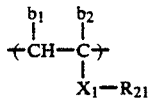

(II)

wherein $b_1$ and $b_2$ each represents a hydrogen atom, a halogen atom, a cyano group, a hydrocarbon group, $-COOR_{24}$ or $-COOR_{24}$ bonded via a hydrocarbon group (wherein $R_{24}$ represents a hydrogen atom or a hydrocarbon group); $X_1$ represents —COO—, —OCO—, $-(CH_2)_{l_1}-OCO-$, $-(CH_2)_{l_2}-COO-$ (wherein $l_1$ and $l_2$ each represents an integer of from 1 to 3), —O—, $-SO_2-$, —CO—,

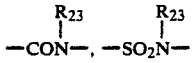

(wherein $R_{23}$ represent a hydrogen atom or a hydrocarbon group), —CONHCOO—, —CONHCONH—, or

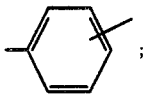

and $R_{21}$ represents a hydrocarbon group, provided that when $X_1$ represents

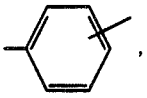

$R_{21}$ represents a hydrogen atom or a hydrocarbon group.

2. An electrophotographic light-sensitive material as claimed in claim 1, wherein the copolymerizable component of a repeating unit represented by the general formula (I) is an aryl group-containing methacrylate component of the repeating unit represented by the following general formula (Ia) or (Ib):

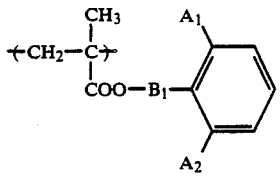

(Ia)

wherein $A_1$ and $A_2$ each represents a hydrogen atom, a hydrocarbon group having from 1 to 10 carbon atoms, a chlorine atom, a bromine atom, —$COD_1$ or —$COOD_2$, wherein $D_1$ and $D_2$ each represents a hydrocarbon group having from 1 to 10 carbon atoms; and $B_1$ and $B_2$ each represents a mere bond or a linking group containing from 1 to 4 linking atoms, which connects —COO— and the benzene ring.

3. An electrophotographic light-sensitive material as claimed in claim 1, wherein the graft type copolymer contains the macromonomer (M) and a polymerizable component represented by the following general formula (III):

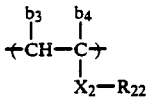

(III)

wherein $b_3$ and $b_4$ each represents a hydrogen atom, a halogen atom, a cyano group, a hydrocarbon group, —$COOR_{24}$ or —$COOR_{24}$ bonded via a hydrocarbon group (wherein $R_{24}$ represents a hydrogen atom or a hydrocarbon group); $X_2$ represents —COO—, —OCO—, $-(CH_2)_{l_1}-OCO-$, $-(CH_2)_{l_2}-COO-$ (wherein $l_1$ and $l_2$ each represents an integer of from 1 to 3),—O—, —$SO_2$—, —CO—,

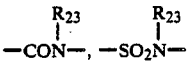

(wherein $R_{23}$ represent a hydrogen atom or a hydrocarbon group), —CONHCOO—, —CONHCONH—, or

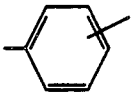

;

and $R_{22}$ represents a hydrocarbon group, provided that when $X_1$ represents

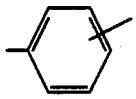

, $R_{22}$ represents a hydrogen atom or a hydrocarbon group.

4. An electrophotographic light-sensitive material as claimed in claim 3, wherein a ratio of the macromonomer (M) to the monomer of the general formula (III) is 1 to 60/99 to 40 by weight.

5. An electrophotographic light-sensitive material as claimed in claim 1, wherein the acidic group in the acidic group-containing copolymerizable component of the resin having a weight average molecular weight of from $1\times10^3$ to $2\times10^4$ is —$PO_3H_2$, —$SO_3H$, —COOH,

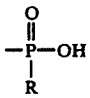

or a cyclic acid anhydride-containing group.

6. An electrophotographic light-sensitive material as claimed in claim 1, wherein the resin having a weight average molecular weight of from $1\times10^3$ to $2\times10^4$ further contains from 1 to 20% by weight of a copolymerizable component having a heat- and/or photo-curable functional group.

7. An electrophotographic light-sensitive material as claimed in claim 1, wherein the acidic group in the A block is —COOH, —$SO_3H$, a phenolic hydroxyl group or

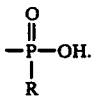

8. An electrophotographic light-sensitive material as claimed in claim 1, wherein a ratio of the A block to the B block is 1 to 30/99 to 70 by weight.

9. An electrophotographic light-sensitive material as claimed in claim 1, wherein a ratio of the resin having a weight average molecular weight of from $1\times10^3$ to $2\times10^4$ to the graft type copolymer is 5 to 50/95 to 50 by weight.

* * * * *